US009212532B2

(12) United States Patent
Leuchtenberg et al.

(10) Patent No.: US 9,212,532 B2
(45) Date of Patent: Dec. 15, 2015

(54) BLOWOUT PREVENTER ASSEMBLY

(75) Inventors: Christian Leuchtenberg, Singapore (SG); Alexander John MacGregor, Singapore (SG)

(73) Assignee: Managed Pressure Operations PTE, Limited, Singapore (SG)

( * ) Notice: Subject to any disclaimer, the term of this patent is extended or adjusted under 35 U.S.C. 154(b) by 1 day.

(21) Appl. No.: 13/640,933

(22) PCT Filed: Apr. 13, 2011

(86) PCT No.: PCT/GB2011/050737
§ 371 (c)(1), (2), (4) Date: Mar. 5, 2013

(87) PCT Pub. No.: WO2011/128690
PCT Pub. Date: Oct. 20, 2011

(65) Prior Publication Data

US 2013/0168578 A1 Jul. 4, 2013

Related U.S. Application Data

(60) Provisional application No. 61/323,814, filed on Apr. 13, 2010.

(30) Foreign Application Priority Data

Mar. 23, 2011 (GB) ..... 1104885.7

(51) Int. Cl.
*E21B 33/06* (2006.01)
*E21B 33/08* (2006.01)
*E21B 21/08* (2006.01)

(52) U.S. Cl.
CPC ..... *E21B 33/06* (2013.01); *E21B 21/08* (2013.01); *E21B 33/085* (2013.01)

(58) Field of Classification Search
CPC ..... E21B 33/06; E21B 33/085; E21B 33/061
USPC ..... 251/1.1, 1.2, 1.3; 166/84.3
See application file for complete search history.

(56) References Cited

U.S. PATENT DOCUMENTS 2,192,805 A * 3/1940 Seamark ..... 277/332
2,731,281 A 1/1956 Knox (Continued)

FOREIGN PATENT DOCUMENTS

EP 1061231 A2 12/2000
EP 1659260 A2 5/2006

(Continued)

OTHER PUBLICATIONS

Search Report for GB1104885.7, dated Apr. 18, 2011.

(Continued)

*Primary Examiner* — John K Fristoe, Jr.
*Assistant Examiner* — Andrew J Rost
(74) *Attorney, Agent, or Firm* — Bracewell & Giuliani LLP; Constance Gall Rhebergen; Linda L. Morgan

(57) ABSTRACT

A blowout preventer assembly comprising an annular blowout preventer having an annular packing unit and an actuator operable to reduce the internal diameter of the annular packing unit, wherein the assembly further comprises a stripping sleeve having a tubular elastomeric sleeve which in use is positioned generally centrally of the packing unit so that the packing unit surrounds at least a portion of the elastomeric sleeve.

10 Claims, 19 Drawing Sheets

(56) References Cited

U.S. PATENT DOCUMENTS

| | | | | | |
|---|---|---|---|---|---|
| 2,904,357 | A | | 9/1959 | Knox | |
| 3,168,320 | A | | 2/1965 | Sneed | |
| 3,225,831 | A | | 12/1965 | Knox | |
| 3,561,723 | A | * | 2/1971 | Cugini | 251/1.2 |
| 3,614,111 | A | * | 10/1971 | Regan | 251/1.2 |
| 3,827,487 | A | | 8/1974 | Jackson et al. | |
| 3,871,665 | A | | 3/1975 | Burke et al. | |
| 4,358,085 | A | * | 11/1982 | Regan et al. | 251/1.2 |
| 4,949,785 | A | | 8/1990 | Beard et al. | |
| 5,074,518 | A | | 12/1991 | Berry | |
| 5,080,174 | A | | 1/1992 | Hynes | |
| 5,100,950 | A | | 3/1992 | Carlson et al. | |
| 5,178,215 | A | * | 1/1993 | Yenulis et al. | 166/95.1 |
| 5,224,557 | A | * | 7/1993 | Yenulis et al. | 175/195 |
| 5,273,108 | A | * | 12/1993 | Piper | 166/90.1 |
| 5,361,832 | A | | 11/1994 | Van Winkle | |
| 6,109,348 | A | * | 8/2000 | Caraway | 166/84.3 |
| 6,554,016 | B2 | * | 4/2003 | Kinder | 137/12 |
| RE38,249 | E | | 9/2003 | Tasson et al. | |
| 6,749,172 | B2 | * | 6/2004 | Kinder | 251/1.2 |
| 6,896,076 | B2 | * | 5/2005 | Nelson et al. | 175/57 |
| 7,004,444 | B2 | * | 2/2006 | Kinder | 251/1.2 |
| 7,007,913 | B2 | * | 3/2006 | Kinder | 251/1.2 |
| 2004/0113108 | A1 | | 6/2004 | Ward | |
| 2008/0302536 | A1 | | 12/2008 | Kotrla et al. | |
| 2009/0161997 | A1 | | 6/2009 | Beauchamp et al. | |

FOREIGN PATENT DOCUMENTS

| | | | |
|---|---|---|---|
| GB | 326615 | A | 3/1930 |
| GB | 627196 | A | 8/1949 |
| GB | 1294288 | A | 10/1972 |
| RU | 2198282 | C2 | 5/2002 |
| WO | 9807956 | A1 | 2/1998 |
| WO | 2008024265 | A2 | 2/2008 |
| WO | 2009017418 | A1 | 2/2009 |
| WO | 2009021037 | A2 | 2/2009 |
| WO | 2011128690 | A1 | 10/2011 |

OTHER PUBLICATIONS

International Search Report for PCT/GB2011/050737 dated Sep. 6, 2011—2 pages.

* cited by examiner

BLOWOUT PREVENTER ASSEMBLY

BACKGROUND OF INVENTION

1. Field of the Invention

Embodiments disclosed herein generally relate to annular blowout preventers used in the oil and gas industry. Specifically, embodiments selected relate to a new type of retrievable stripping sleeve for use with an annular type blowout preventer or similar device. 'Stripping' is defined as the act of pushing or pulling tubular's through an annular preventer element under pressure or without pressure with the stripping element closed around the tubular.

2. Background Art

Well control is an important aspect of oil and gas exploration. When drilling a well, for example, in oil and gas exploration applications, safety devices must be put in place to prevent injury to personnel and damage to equipment resulting from unexpected events associated with the drilling activities.

Drilling wells in oil and gas exploration involves penetrating a variety of subsurface geologic structures, or "layers." Occasionally, a wellbore will penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore then uphole (from a high pressure region to a low pressure region). If the kick is allowed to reach the surface, drilling fluid, well tools, and other drilling structures may be blown out of the wellbore. These "blowouts" may result in catastrophic destruction of the drilling equipment (including, for example, the drilling rig) and substantial injury or death of rig personnel.

Because of the risk of blowouts, blowout preventers ("BOPs") are typically installed at the surface or on the sea floor in deep water drilling arrangements to effectively seal a wellbore until active measures can be taken to control the kick. BOPs may be activated so that kicks are adequately controlled and "circulated out" of the system. There are several types of BOPs, one common type of which is an annular blowout preventer.

Annular BOPs typically comprise annular, elastomeric "packing units" that may be activated to encapsulate drillpipe and well tools to completely seal about a wellbore. In situations where no drillpipe or well tools are within the central bore or passage of the packing unit, the packing unit can be compressed to such an extent that the central bore or passage is entirely closed, acting as a valve on the wellbore. Typically, packing units are used in the case of sealing about a drillpipe, in which the packing unit can be quickly compressed, ether manually or automatically, to effect a seal about the pipe to prevent a well from blowing out.

An example of an annular BOP having a packing unit is disclosed in U.S. Pat. No. 2,609,836, ("Knox") and incorporated herein by reference. The packing unit includes a plurality of metal inserts embedded in an elastomeric body. The metal inserts are typically spaced equal circumferential distances from one another about a longitudinal axis of the packing unit. The inserts provide structural support for the elastomeric body when the packing unit is radially compressed to seal against the well pressure. Upon compression of the packing unit about a drillpipe, or upon itself, to seal against the wellbore pressure, the elastomeric body is squeezed radially inwardly, causing the metal inserts to move radially inwardly as well.

FIG. 1 shows an example of a prior art 'wedge type' annular BOP 10 including a housing 12. The annular BOP 10 has a central bore or passage 14 extending from top to bottom and is disposed about a longitudinal axis. A packing unit 16 is disposed within the annular BOP 10 about the longitudinal axis A. The packing unit 16 includes an elastomeric annular body 18 and a plurality of metallic inserts 30. The metallic inserts 30 are disposed within the elastomeric annular body 18 of the packing unit 16 and distributed at equal circumferential distances from one another about the longitudinal axis A. The metallic inserts 30 each comprise an upper finger 30*a* and a lower finger 30*b* joined by a metal stabilising plate, the elastomeric body 18 lying between the upper 30*a* and lower 30*b* fingers. The packing unit 16 includes a generally central bore or passage 20 concentric; with the generally central bore or passage 14 of the BOP 10.

The annular BOP 10 is actuated by fluid pumped into a piston chamber in the housing 12 via first port 22. The fluid applies pressure to a piston 24, which moves the piston 24 upward. As the piston 24 moves upward, the piston 24 exerts a force on the packing unit 16 through a wedge face 26. The force exerted on the packing unit 16 from the wedge face 26 is directed upwards toward a removable head 28 of the annular BOP 10, and inwards toward the longitudinal axis A of the annular BOP 10. Because the packing unit 16 is retained against the removable head 28 of the annular BOP 10, the packing unit 16 does not displace upwardly from the force exerted on the packing unit 16 by the piston 24. The relaxed state of the packing unit 16 is shown in FIG. 2A.

However, the packing unit 16 does displace inwardly from the force from the piston 24, which compresses the packing unit 16 toward the longitudinal axis of the annular BOP 10. In the event a drill pipe 32 is located along the longitudinal axis A, with sufficient radial compression, the packing unit 16 will seal about the drill pipe 32 into a "closed position." The closed position is shown in FIG. 2B. In the event a drill pipe is not present, the packing unit 16, with sufficient radial compression, will completely seal the generally central bore or passage 20. The annular BOP 10 goes through an analogous reverse movement when fluid is pumped into second port 34 into the piston chamber 36 and released from the first port 22. The fluid exerts a downward force on the piston 24, such that the wedge face 26 of the piston 24 allows the packing unit 16 to radially expand to an "open position." The open position is shown in FIG. 2A. Further, the removable head 28 of the annular BOP 10 enables access to the packing unit 16, such that the packing unit 16 may be serviced or changed if necessary.

FIG. 3 is an example of a prior art 'spherical type' BOP 110 disposed about a longitudinal axis as disclosed in U.S. Pat. No. 3,667,721 (issued to Vujasinovic and incorporated by reference in its entirety). The spherical BOP 110 includes a lower housing 112 and an upper housing 128 releasably fastened together by a plurality of bolts 142. Typically, the upper housing 128 has a curved, semi-spherical inner surface 144. A packing unit 116 is disposed within the spherical BOP 110 about the longitudinal axis. The packing unit 116 includes a curved, elastomeric annular body 118 and curved metallic inserts 130 to correspond to the curved, semi-spherical inner surface 118 of the upper housing 128. The metallic inserts 130 are then distributed equal circumferential distances from one another within the curved, elastomeric annular body 118. The spherical BOP 110 may be actuated by fluid, similar to the annular BOP 10 of FIG. 1 as described above. FIGS. 4*a* and 4*b* show the open and closed positions respectively for the packing unit 116 on the drill pipe 32 for this spherical type BOP.

For all the above patents cited there is a common design feature in that the annular element is in direct contact with the drill pipe 32 or other tubular being sealed against. This gives a limited life of the packing element when used in 'stripping' operations. Stripping occurs when the pipe is moved into the wellbore or out of the wellbore under pressurized wellbore conditions with the element squeezed against the drillpipe. This results in substantial wear when the stripping is done for several thousand feet e.g. when pulling the drillbit all the way from bottom. This wear affects the integrity and sealability of the packing element.

For the annular BOP designs shown and all annular BOP designs on the market, it is required to dismantle the annular BOP to access the element and to change for a new element. This requires work to be stopped and in the case of repair to subsea annular BOPs can result in substantial non-productive time.

To overcome this substantial drawback of wear and maintenance a retrievable isolation tool 246 is proposed in U.S. Pat. No. 6,450,262, the isolation tool 246 being inserted at the level of the annular BOPS previously discussed.

In U.S. Pat. No. 6,450,262, in accordance with its illustrated and preferred embodiments, the isolation tool, as shown in FIG. 5 comprises a housing 248 adapted to be connected as a lower continuation of the riser and having a generally central bore or passage 214 through which the drill string 32 may extend during the drilling of the well, an annular recess 250 about the generally central passage, and a side port 252 below the recess for connecting the generally central passage to a mud return line extending alongside of the riser and leading to the surface. An insert packer 254 including a sleeve of elastomeric material 256 is adapted to be lowered into and raised from a landed position in the generally central passage opposite an actuator 258 within the housing recess 250 having a sleeve of elastomeric material 260 which, when retracted, occupies a position in which the insert packer 260 may be removed, forming a continuation of the generally central bore or passage so as to receive a drill string there through. When the insert packer 254 is in place, the actuator sleeve 258 is responsive to the supply of control fluid thereto from an outside source to engage and contract the sleeve 256 of the insert packer 254 about the drill string 32, so that the drilling fluid flowing upwardly in the annulus between the riser and drill string 32 is directed into the side port in the housing from the generally central bore or passage 214. In response to the exhaust of the control fluid, the insert packer sleeve 256 is free to expand to fully open the generally central passage and the insert 254 to be removed.

Also shown in FIG. 5, is a set of hydraulically operated pins 262 or bolts carried by the housing 248 so that, when moved inwardly, they provide a landing shoulder in the housing generally central bore or passage 214 to position the insert packer 254 opposite the actuator 258. A second set of hydraulically operated pins 264 carried by the housing are adapted to be moved into an annular groove 266 about the insert packer 254 to lock the insert packer in place to prevent its up or down movement in the generally central bore or passage 214. An upward pull on the drill string 32 can confirm the lock down of the insert packer 254. The annulus between the housing generally central bore or passage 214 and the insert packer 254 may be sealed off by contraction of the actuator sleeve 258 by means of fluid pressure supplied to the recess 250 about the sleeve to close about the drill string 32 to seal off well fluid in the annulus above and below it. The pressure is such as to allow the drill string and its tool joints to pass through it while maintaining a seal (stripping) in either direction. The actuator 258 also includes metal rings 268 at both ends of sleeve 260, each carrying a seal ring (not shown) thereabout to seal off the recess 250 to contain actuating fluid in the recess 250.

This patent proposes a retrievable 'packing insert' that is a custom component of the 'riser isolation tool'. A problem with this solution is that it requires a custom installation of the riser isolation tool that limits the use of this packing insert to that type of subsea installation as described in the patent.

SUMMARY OF INVENTION

According to a first aspect of the invention we provide a blowout preventer assembly comprising an annular blowout preventer having an annular packing unit and an actuator operable to reduce the internal diameter of the annular packing unit, wherein the assembly further comprises a stripping sleeve having a tubular elastomeric sleeve which in use is positioned generally centrally of the packing unit so that the packing unit surrounds at least a portion of the elastomeric sleeve.

This design results in a substantial elastomeric material thickness available for wear during operational use. This may assist in preserving the integrity of the blowout preventer for normal operations by not wearing its element. The stripping sleeve is thus a wearable, disposable item that needs to be designed to be easily inserted and removed from operation.

The actuator may comprise a piston movable generally parallel to the longitudinal axis of the blow out preventer by the supply of pressurised fluid to the annular blow out preventer.

Advantageously, the stripping sleeve further comprises two annular support parts, the elastomeric sleeve being positioned between the two support parts. The outer diameter of each of the support parts may be greater than the outer diameter of the elastomeric sleeve. In this case, the annular packing unit may comprise an elastomeric body and at least one generally rigid insert, the insert lying at least partially between the two annular support parts when the annular packing unit engages with the elastomeric sleeve. Furthermore, the annular packing unit may comprise first and second generally rigid, may be metallic, inserts, the elastomeric body lying between the first and second inserts and the first insert being at a first end of the annular packing unit adjacent to one of the support parts and the second insert being at a second end of the annular packing unit adjacent to the other of the support parts, both inserts lying at least partially between the two support parts when the packing unit is engaged with the elastomeric sleeve.

The inner diameter each of the support parts may be substantially the same as the inner diameter of the elastomeric sleeve.

Each support part may be provided with a circular ridge which extends into an end of the elastomeric sleeve.

Advantageously the maximum outer diameter of the stripping sleeve is less than the inner diameter of the annular packing unit when the packing unit is not acted on by the actuator.

By virtue of this, it is possible that the stripping sleeve does not permanently affect the bore of the system or the integrity of the blowout preventer or its packing unit. Moreover, the stripping sleeve can be applied easily on the most common wellbore configurations in use today for drilling and can be easily delivered into the wellbore for operations.

In certain embodiments of the invention, the stripping sleeve further comprises a polymeric sealing element which is arranged radially inwardly of the elastomeric sleeve. In this case, the polymeric sealing element may contain a plurality of apertures into which the elastomeric sleeve extends.

According to a second aspect of the invention we provide a blow out preventer assembly including two annular blow out preventers and stripping sleeves having any of the features set out above, wherein the two annular blow out preventers are arranged around a common central passage and are longitudinally displaced with respect to one another along the common central passage, and the two stripping sleeves are connected by means of a tubular connector.

In this case, the packing units and actuators of the annular blow out preventers may be contained in a housing which encloses the common central passage, there being a conduit provided in the housing to connect the volume of the common central passage between the two annular blow out preventers with the exterior of the housing.

According to a third aspect of the invention we provide a method of operating a blow out preventer assembly according to the second aspect of the invention, the blow out preventer assembly being subjected to fluid at a first pressure at a first end of the assembly and to fluid at a second pressure at a second end of the assembly, the method comprising connecting to the conduit provided in the housing to fluid at a third pressure, the third pressure being higher than the first pressure and lower that the second pressure.

This makes use of the fact that experience with annular preventers over the years has shown that lower rates of wear of the elements are experienced with lower well pressures. In this way the wellbore pressure can be staged down to reduce the overall pressure drop across each stripping sleeve. This may further enhance the longevity of the stripping sleeves. Such a system may also allow detection of leakage of any of the elements.

Such a method also allows the staging through of the larger diameter tool-joints as it is well known to those skilled in the art of stripping that leaks are most likely to occur when stripping with a change in diameter of the tubular. Having two stripping sleeves spaced further apart than the total tool-joint length further enhances the pressure retaining properties of the system disclosed.

DETAILED DESCRIPTION

Figure 6C:
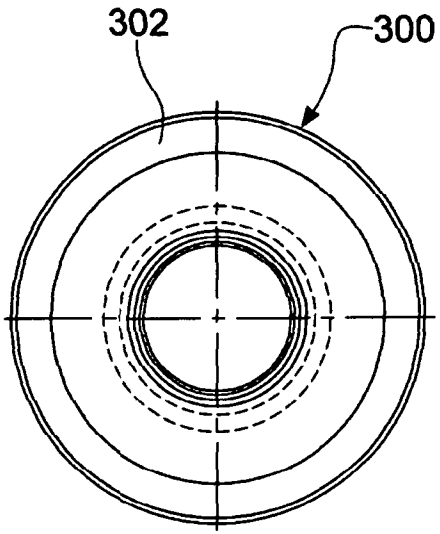
FIG. 6*c* is a plan view of the stripping sleeve, shown in FIG. 6*a*.
Figure 6B:
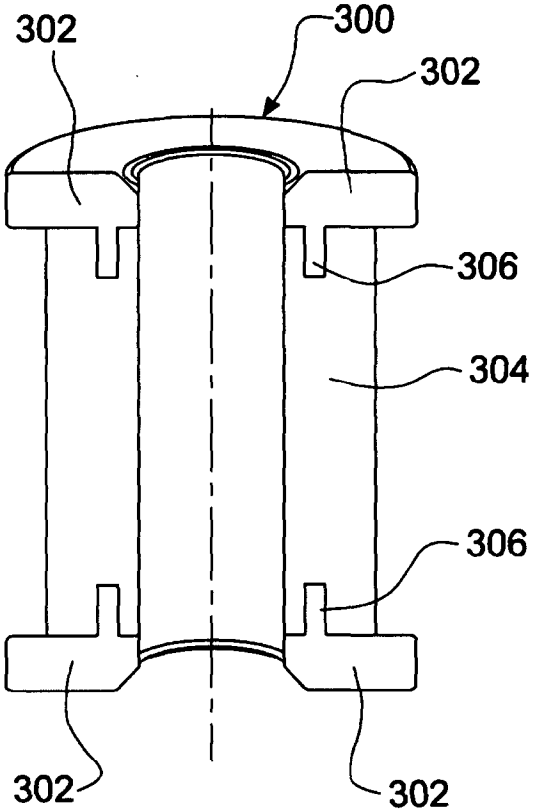
FIG. 6*b* is a cross-sectional view of the stripping sleeve, shown in FIG. 6*a*.
Figure 6A:
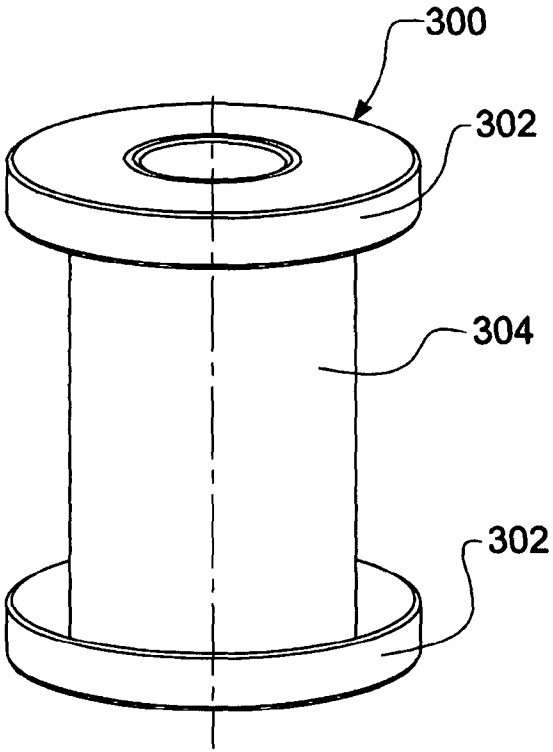
FIG. 6*a* is a perspective view of the stripping sleeve, according to the invention.

Referring now to FIGS. 6*a*, 6*b* and 6*c*, there is shown a stripping sleeve 300 comprising two annular support plates 302 joined by an elastomeric sleeve 304. The outer diameters of the support plates 302 are greater than the outer diameter of the elastomeric sleeve 304, whilst both have substantially identical inner diameters. In this example, the annular support plates 302 both include a circular ridge or flange 306 which extends into a corresponding groove provided in each end of the elastomeric sleeve 304. These ridges 306 are preferably made from steel and may be integral with their respective support plate 302.

The stripping sleeve 300 is designed to be used with any type of annular blow out preventer (BOP) in common use and its size can be adjusted easily to fit the most common BOP configurations used on and fixed offshore drilling installations in the nominal size designated as 13⅝ inch BOP and for floating offshore drilling installations in the nominal size designated as 18¾ inch BOP. This will be described further below.

By making the sleeve 304 from elastomeric material similar to BOP elastomeric elements with top and bottom support plates 302 as shown FIGS. 6*a*, 6*b*, and 6*c*, the stripping sleeve 300 can be held by any of the common types of annular BOP.

Figure 1:
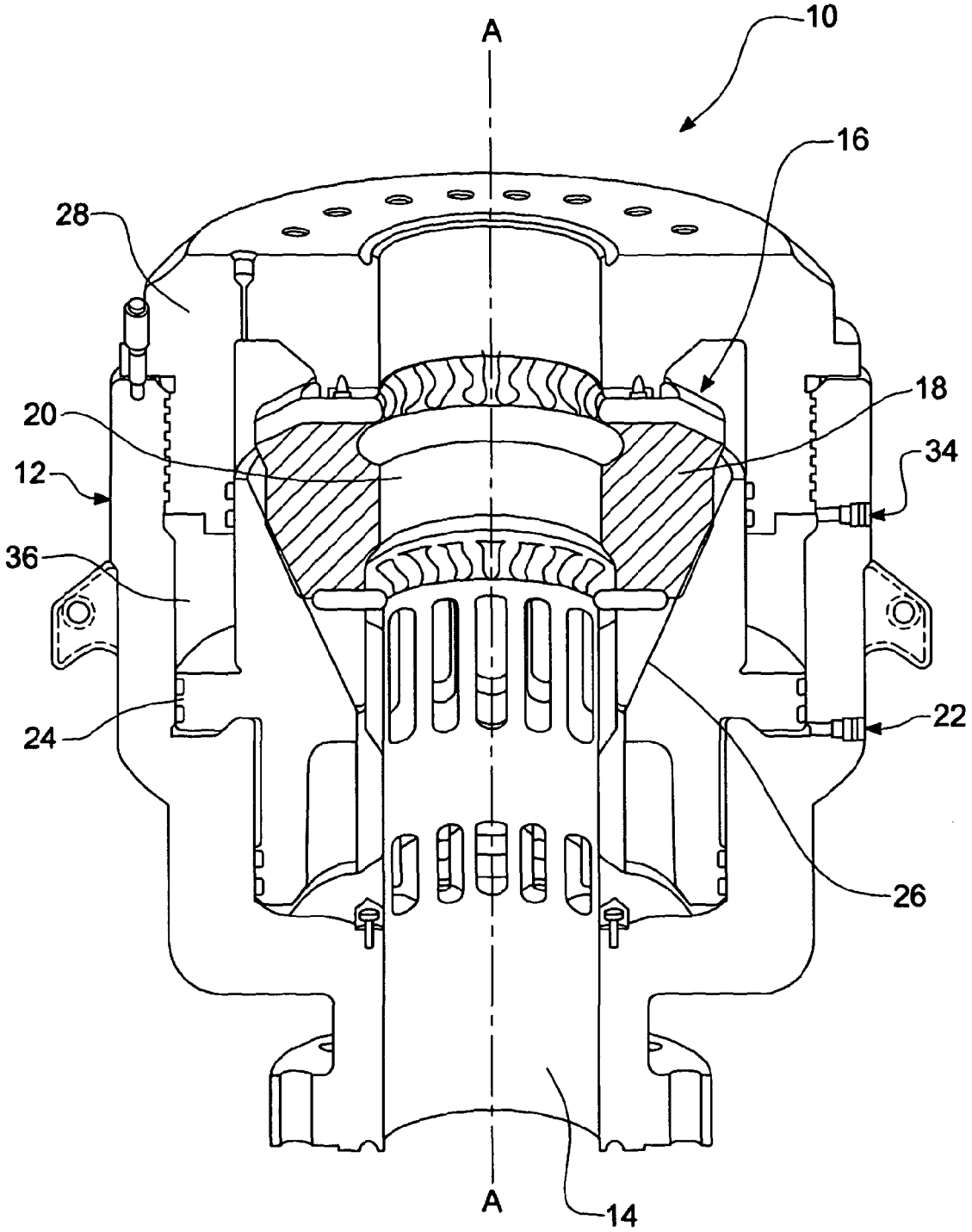
FIG 1 (PRIOR ART)
FIG. 1 is a cutaway view of a prior art wedge type annular blowout preventer.
Figure 7B:
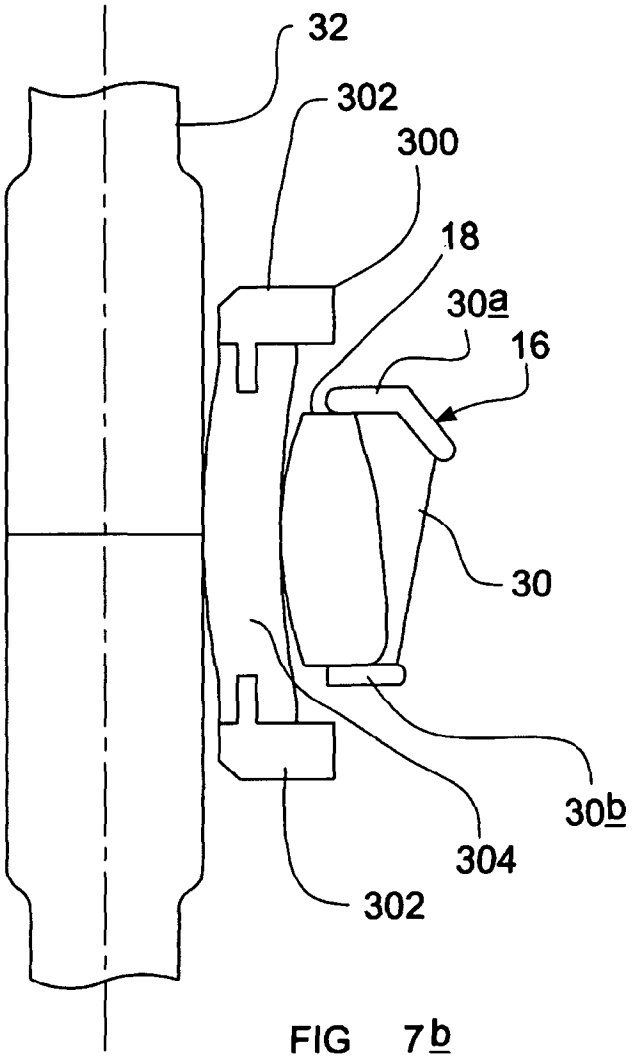
FIG. 7*b* is a cross-sectional view of a portion of the stripping sleeve shown in FIG. 6*a* in use with a wedge type annular blowout preventer with the stripping sleeve opposite the annular blowout preventer packing unit in closed position.
Figure 7A:
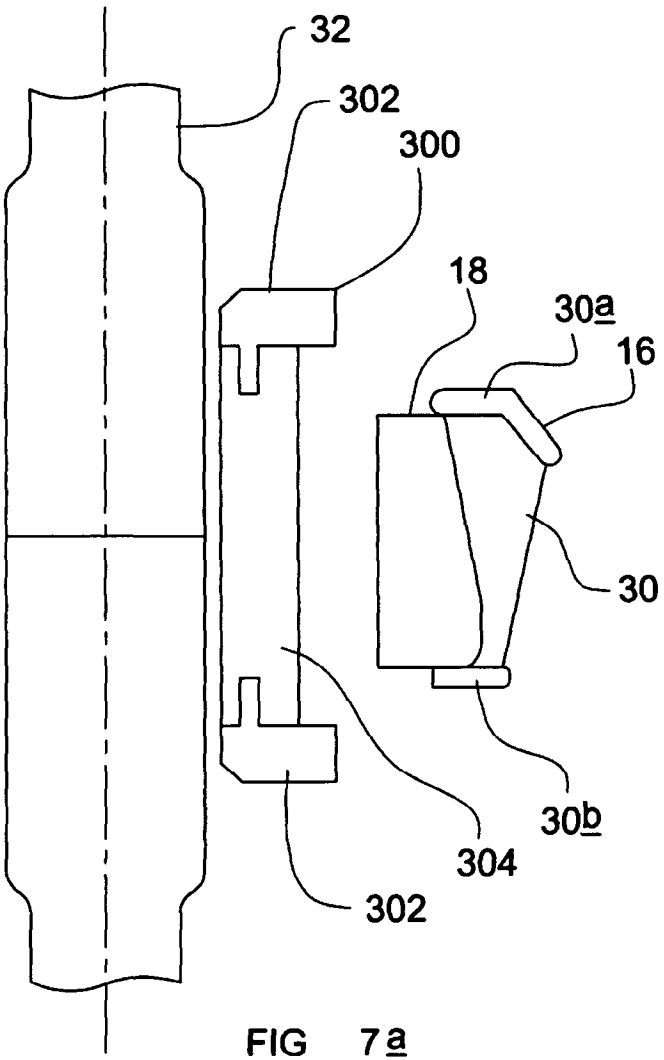
FIG. 7*a* is a cross-sectional view of a portion of the stripping sleeve shown in FIG. 6*a* in use with a wedge type annular blowout preventer with the stripping sleeve opposite the annular blowout preventer packing unit in open position.

The stripping sleeve 300 may, for example be used in conjunction with a wedge type annular BOP such as the one described above in relation to U.S. Pat. No. 2,609,836 and shown in FIGS. 1, 2*a* and 2*b*. FIGS. 7*a* and 7*b* each show a schematic illustration of the stripping sleeve 300 in use in such a BOP 10, these figures showing only a section of drill string 32, and one side of the packing unit 16 of the BOP 10, along with the corresponding section of stripping sleeve 300. FIG. 7*a* shows the BOP 10 in its open position, whilst FIG. 7*b* shows the BOP 10 in its closed position with the packing unit 14 activated so that it engages with the elastomeric sleeve 304 of the stripping sleeve 300 and pushes the elastomeric sleeve 304 into sealing engagement with the drill string 32. This makes the stripping sleeve an 'active' type of stripping sleeve meaning that force has to be applied to restrict the inner diameter of the stripping sleeve as opposed to 'passive' which relies on the natural elasticity of the elastomeric stripping sleeve along with wellbore pressure to press the sleeve into a sealing engagement with drill string 32.

Figure 2B:
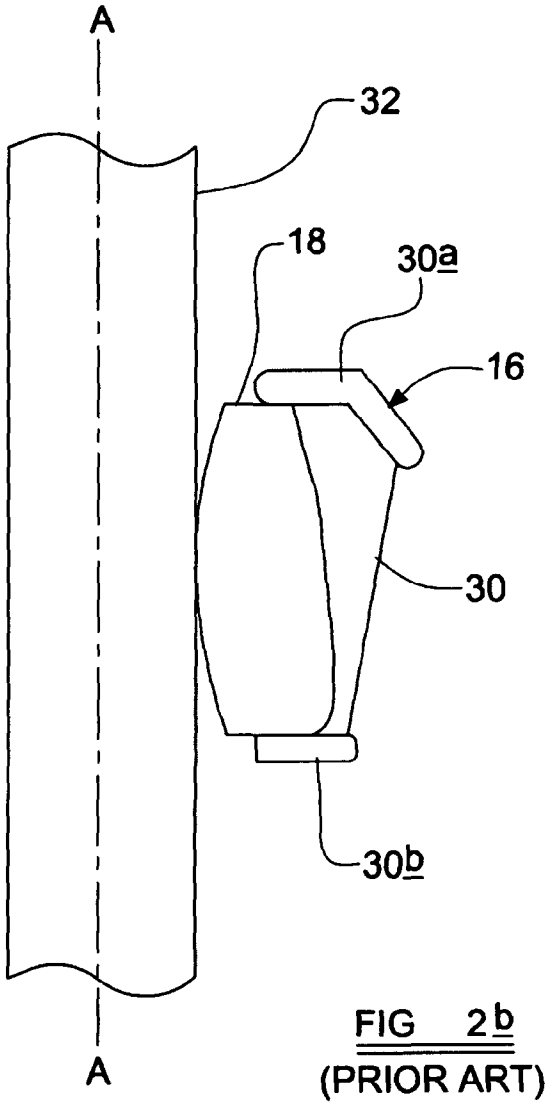
FIG 2b (PRIOR ART)
FIG. 2*b* is a cross-sectional view of a portion of a prior art wedge type annular blowout preventer packing unit in the dosed position.
Figure 2A:
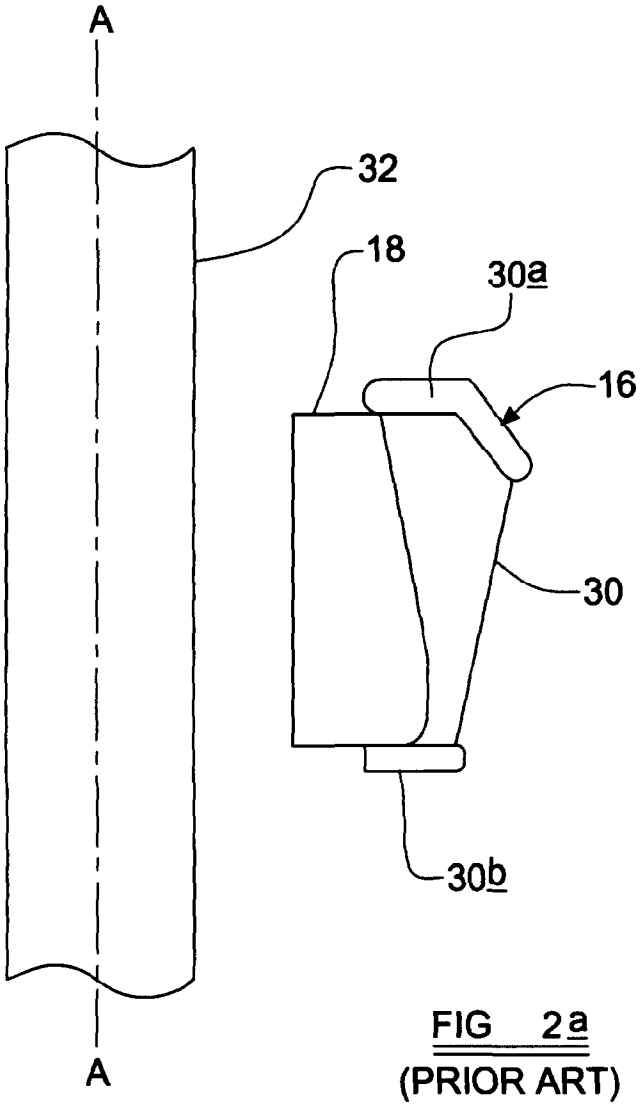
FIG 2a (PRIOR ART)
FIG. 2*a* is a cross-sectional view of a portion of a prior art wedge type annular blowout preventer packing unit in the open position.

As the packing unit 16 is driven in a horizontal annular motion to the closed position as shown in FIG. 7*b*, the elastomeric annular body 18 of the packing unit 16 compresses and reduces in internal diameter, until it contacts the elastomeric sleeve 304 of the stripping sleeve 300. Then, as more force is applied, the stripping sleeve 300 is constricted in internal diameter until it engages with around the drill string 32 effecting a seal. The lower metal fingers 30*b* and upper metal fingers 30*a* associated with the packing unit 16 joined by the metal stabilising plate move in to dose any extrusion gap of the elastomeric body 18 of the packing unit. It should be noted that in this position the elastomeric body 18 of the packing unit 16 is in a far less stressed state than as shown for usual operation which is depicted in FIG. 2B.

In FIGS. 7*a* and 7*b*, the drill string 32 is depicted with the stripping sleeve 300 and packing unit 16 opposite a tool joint, i.e. an increased outer diameter portion of drill string, to show that, with the BOP 10 not activated i.e. in its open position, the stripping sleeve 300 is completely clear of the maximum outer diameter of the drill string 32.

The annular reinforcing ridges 306 within the stripping sleeve 300 will keep the lower and upper portion of the stripping sleeve 300 at a constant diameter to prevent extrusion of the stripping sleeve 300 past the packing unit 16, as pressure is resisted from below or above. In this way the packing unit 16 may be designed for the combined application with the stripping sleeve 300 to ensure that extrusion cannot occur under pressure by ensuring that the upper metal fingers 30*a* and lower metal fingers 30*b* overlap the reinforcing ridges 306 sufficiently.

Figure 8B:
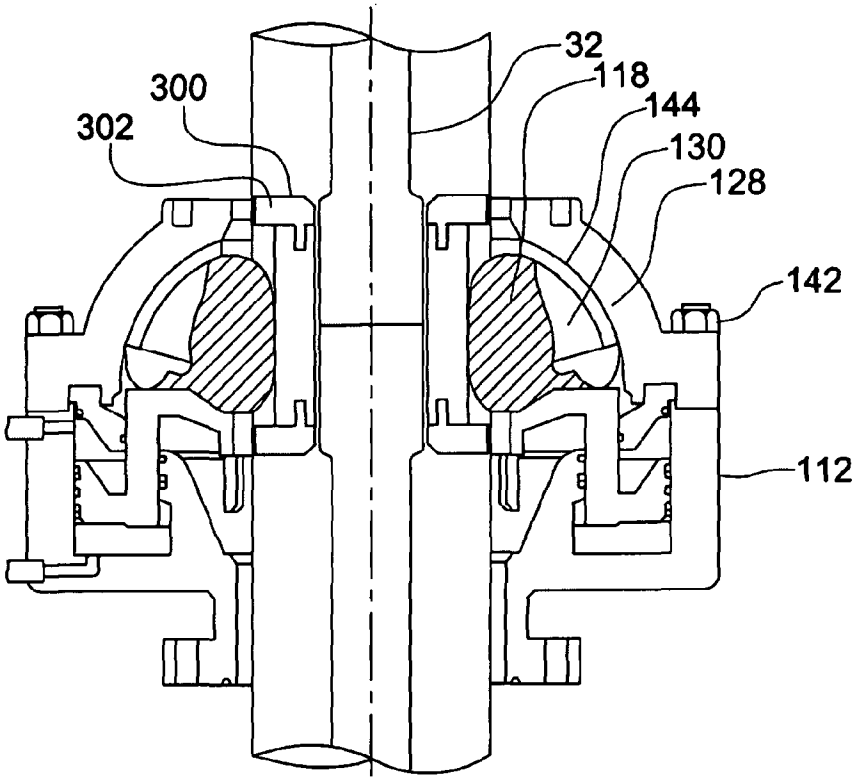
FIG. 8*b* is a cross-sectional view of the stripping sleeve as shown in FIG. 8*a* in use with a spherical type annular blowout preventer with the stripping sleeve held in place with the annular blowout preventer, with no pressure below the blowout preventer.
Figure 8A:
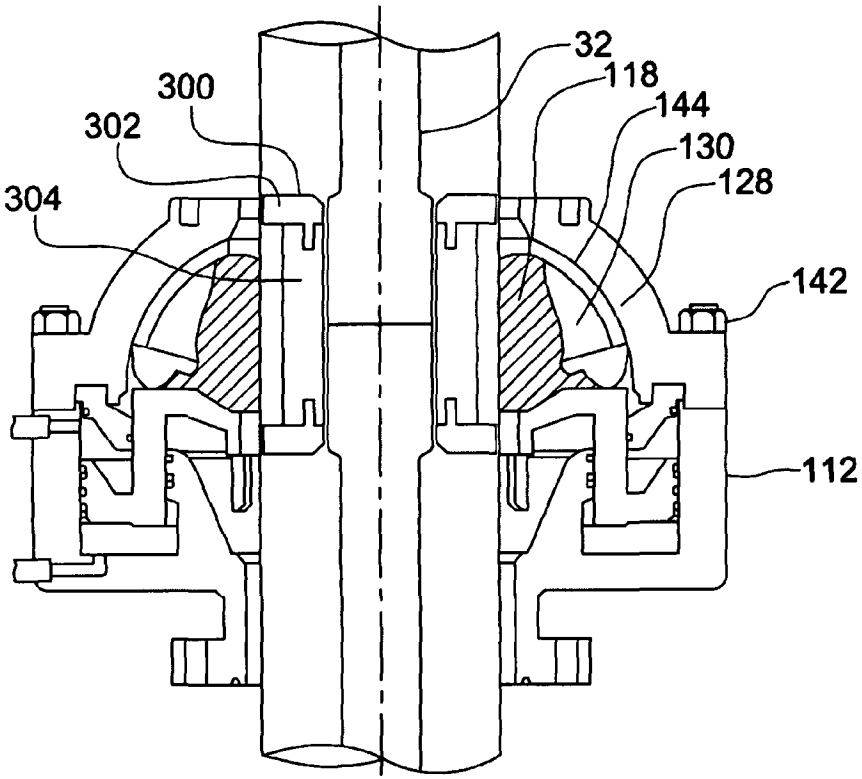
FIG. 8*a* is a cross-sectional view of the stripping sleeve shown in FIG. 6*a* in use with a spherical type annular blowout preventer with the stripping sleeve opposite the annular blowout preventer packing unit in open position with no running tool shown.

The stripping sleeve 300 may also be used in conjunction with a spherical type annular BOP 110 as illustrated in FIGS. 8*a* 8*b*, 8*c*, and 8*d*. These show the stripping sleeve 300 opposite the elastomeric body 118 with the packing unit 116 in open position with no running tool shown. The stripping sleeve 300 is again depicted opposite a tool joint of a drill string 32 to show that with the BOP 110 not actuated, that the stripping sleeve 300 is completely clear of the maximum outer diameter of the drill string 32 which is typical of an 'active' system as described earlier. FIG. 8*a* is not an operational figure. It is merely shown to depict the proportionality of the components in a non-active state.

FIG. 8*b* shows the spherical annular BOP 110 slightly actuated to hold the stripping sleeve 300 in a working position. This would be the typical position when moving tubular in and out of the well bore without pressure i.e. tripping as opposed to stripping.

Figure 8D:
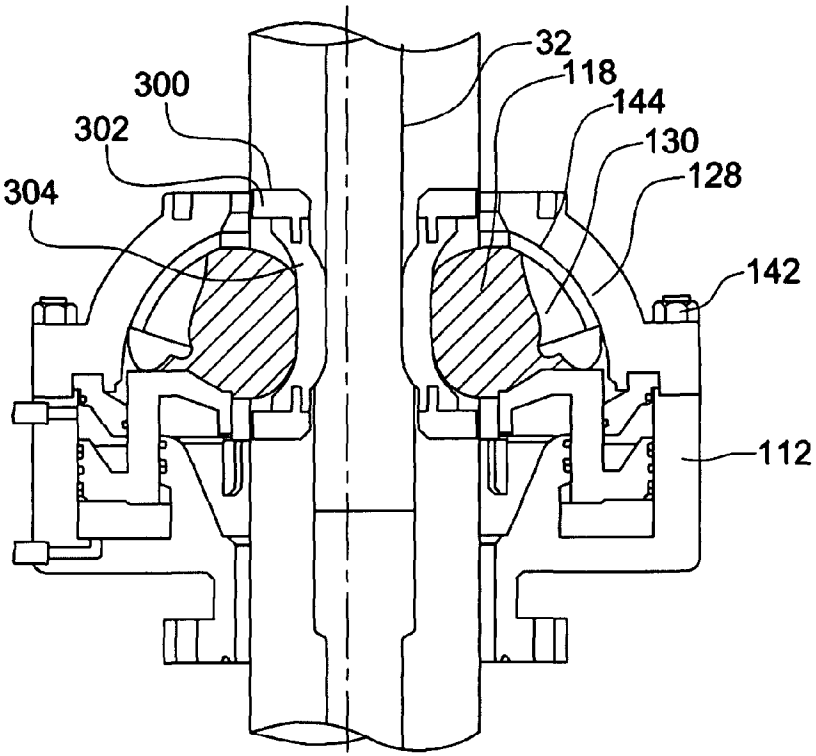
FIG. 8*c* is a cross-sectional view of the stripping sleeve as shown in FIG. 8*a* in use with a spherical type annular blowout preventer with the stripping sleeve opposite the annular blowout preventer in dosed position with a tool joint being stripped through, FIG. 8*d* is a cross-sectional view of the stripping sleeve as shown in FIG. 8*a* in use with a spherical type annular blowout preventer with the stripping sleeve opposite the annular blowout preventer in open position with a tool joint just stripped through, FIG. 9*a* is an illustration of the longitudinal cross-section through the typical stripping sleeve dimension when used in use on an offshore floating installation with nominal 6⅝ inch drillpipe and a 21 inch riser with 18¾ inch blowout preventer.
Figure 8C:
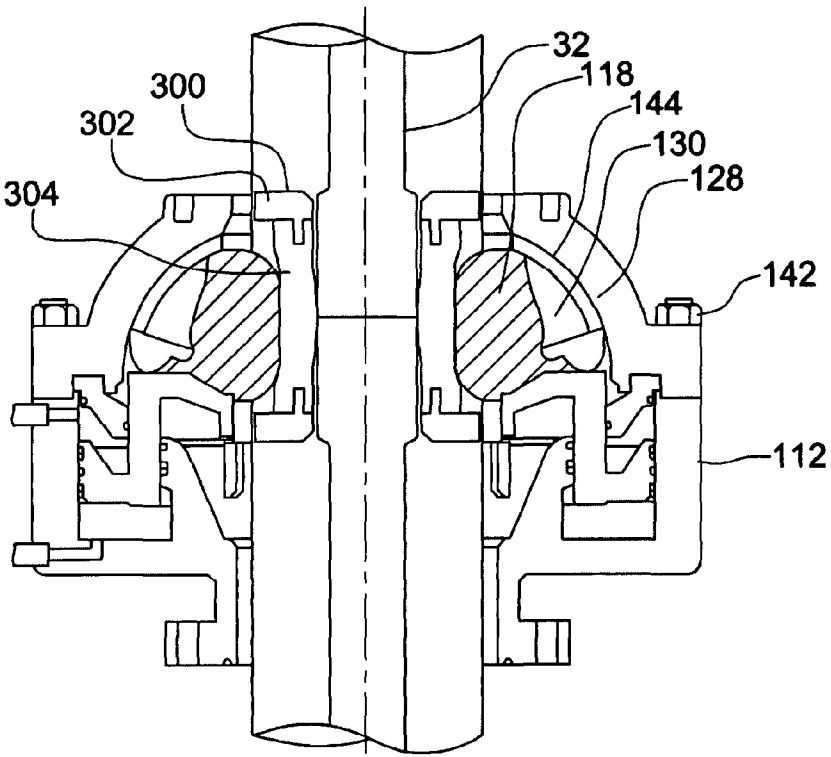

FIG. 8*c* shows the stripping element 300 in active working mode with sufficient pressure applied to seal around the drill string 32 in the vicinity of a tool joint. Typically enough hydraulic pressure will be applied to the hydraulic chamber of the BOP 110 to force the elastomeric body 118 against the stripping sleeve 300 to effect a seal over the whole range of movement required to handle the variance in outer diameter of the drill string 32 being stripped. This is shown in FIG. 8*d*, where the tool joint has almost passed through the stripping sleeve 300 and the seal is continuously effected around the outer diameter of the drill string 32. The variation in hydraulic pressure to make this a smooth operation is achieved by having buffer volumes of compressed gas (accumulators) in contact with the hydraulic fluid supply for the spherical annular BOP 110. This type of system is in common use when using prior art annular BOPs for stripping without a stripping sleeve 300 according to invention.

Figure 9B:
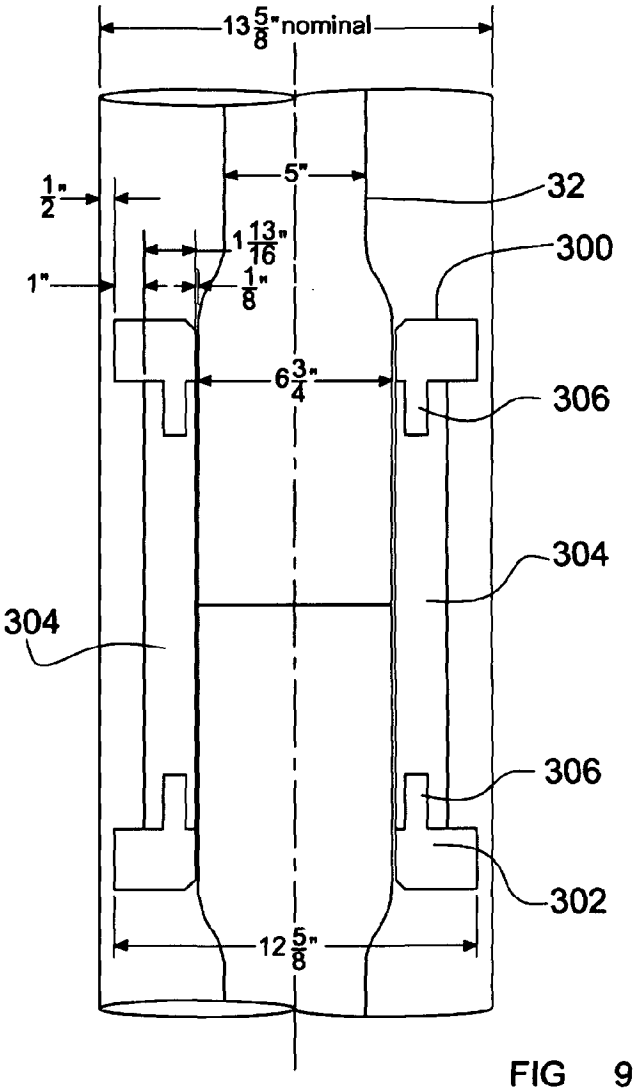
FIG. 9*b* is an illustration of the longitudinal cross-section through the typical stripping sleeve dimension when used in use on a fixed installation with nominal 5 inch drillpipe and 13⅝ inch blowout preventer.
Figure 9A:
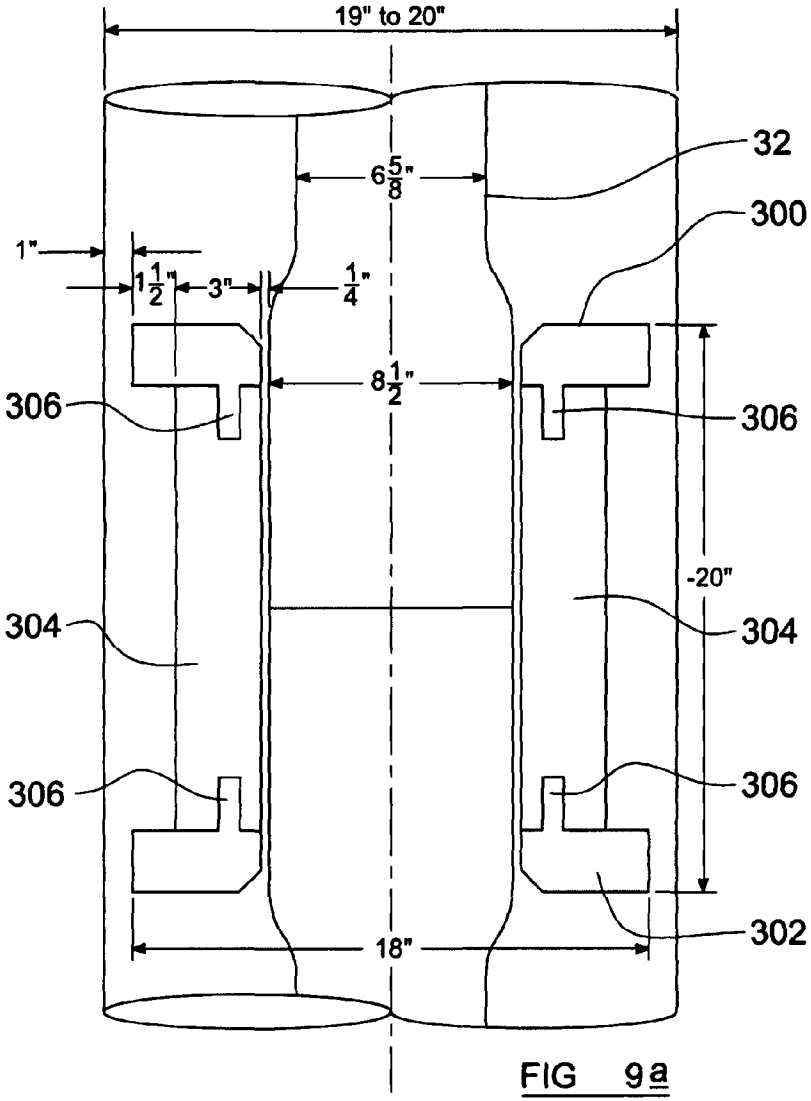

Referring now to FIG. 9*a*, there is shown a cross-sectional view of the typical stripping sleeve dimension when used in use on an offshore floating installation with nominal 6⅝ inch drillpipe and a 21 inch riser with 18¾ inch BOP. This is the most common configuration in use today on floating drilling installations.

In contrast, FIG. 8*b* shows a cross-sectional view of the typical stripping sleeve dimension when in use on a fixed installation with nominal 5 inch drillpipe and 13⅝ inch BOP. This is the most common configuration in use today for offshore fixed installations and larger wellbores on land.

The stripping sleeves described in this patent application can be used in either application, and the dimensions are shown by way of example for illustrative purposes only and do not restrict the scope of the invention. The purpose is to demonstrate technical viability of the concept across various diameters of wellbore in common use.

It will be seen from these figures that the internal diameter of the stripping sleeves is slightly more than the outer diameter of the tool joint being used. The drill strings 32 have a smaller outer diameter over the main body of the drill string 32. This demonstrates active compatibility in that in the relaxed state the stripping sleeve is not constraining the tubular.

The stripping sleeve 300 maximum outer diameter is less than the minimum diameter of the bore of the wellbore system, in this example giving a circumferential clearance of 0.5 inches, and the outer diameter is also below the clearance bore (not shown) of the wellbore system. This ensures that it can be delivered to any point in the wellbore system.

Taking into account all the dimensions shown in FIGS. 9*a* and 9*b*, it can be seen that the stripping sleeve has enough thickness to act as a wearable item during operational use. The clearance gives enough allowance for an upset on the top and bottom flanges to prevent extrusion of the stripping sleeve 300 past the packing unit 16/116 when in use.

Figures 10A, 10B, 10C, 10D:
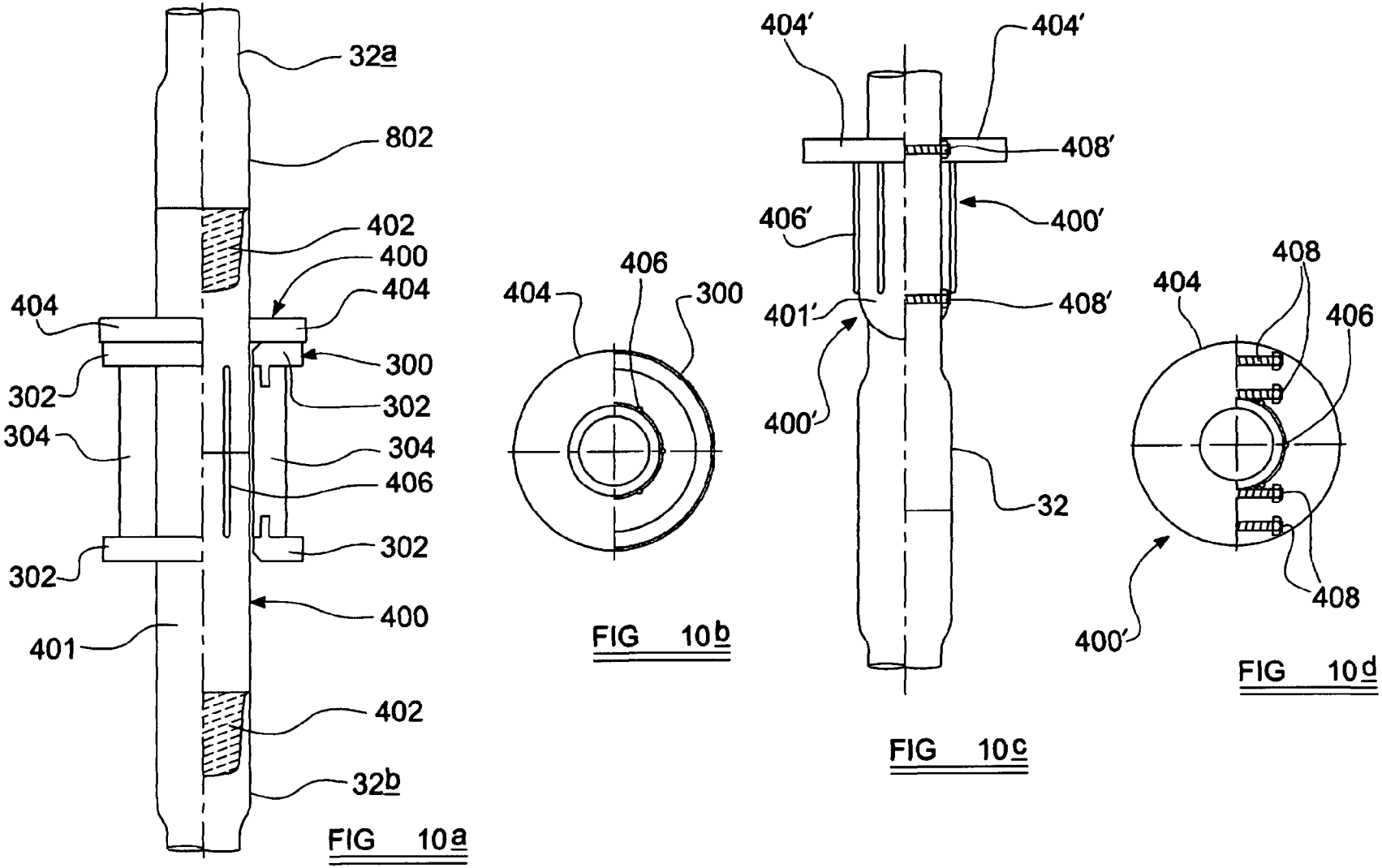
FIG. 10*a* is a semi-cross-sectional view of a running/retrieval tool for the stripping sleeve shown in FIGS. 6*a*, 6*b* and 6*c* designed to be used on any installation.
FIG. 10*b* is a plan view of the running/retrieval tool shown in FIG. 10*a*.
FIG. 10*c* is a semi-cross-sectional view of another type of running/retrieval tool for the stripping sleeve shown in FIGS. 6*a*, 6*b* and 6*c* designed to be used on any installation.
FIG. 10*d* is a plan view of the running/retrieval tool shown in FIG. 10*c*.

Referring now to FIGS. 10*a* and 10*b*, there is shown a semi-cross-sectional view of a sub based running/retrieval tool 400 designed to be installed between two tubulars. It is shown with a stripping sleeve 300 assembled on it. The sub 401 is of the same outer diameter as the tool joints for the tubular system and is connected by the same thread system 402 as the tubular system. It has an upper flange 404 whose outer diameter is equivalent to the clearance diameter of that wellbore system. This ensures that the stripping sleeve 300, whose outer diameter is less than the clearance diameter and by default less than the flange outer diameter can be delivered into position opposite the annular BOP packing units 16, 116 in an undisturbed, undamaged and centralised manner. The sub 401 has a generally cylindrical body with fingers 406 running along the exterior surface of the body generally parallel to its longitudinal axis, and these give an upset slightly larger than the inner diameter of the stripping sleeve 300. This can be seen more clearly in FIG. 10*b* which shows that there are six fingers 406 in this embodiment of running/retrieval tool 400. The stripping sleeve 300 is placed around the cylindrical body of the tool 400 so that the fingers 406 cause the elastomeric sleeve 304 of the stripping sleeve to deform slightly. This causes the stripping sleeve 300 to be retained on the running/retrieval tool 400 in an interference fit firmly for installation and retrieval of the stripping sleeve 300.

FIG. 10*c* is a semi-cross-sectional view of an alternative embodiment of running/retrieval tool 400'. This embodiment of running/retrieval tool 400' is designed to be installed on the main body of a drill string 32 or other tubular. It is shown without the stripping sleeve 300 installed and FIG. 10*d* gives a plan view, it is made in two halves held together by bolts 408' or other suitable fastener, and the two halves are placed around the drill string 32 before being secured together. The drill string 32 is therefore damped between the two halves of the tool 400'. The tool 400' has an annular upper flange 404', a generally cylindrical tubular main body 401' which has the same outer diameter as the tubular tool joints and longitudinally extending fingers 406' which are the same dimensions as in the previous sub based tool 400. The stripping sleeve 300 is mounted over the main body 401' with the fingers 406' gripping the elastomeric sleeve 304 of the stripping sleeve 300 in an interference fit as in the previous embodiment of running retrieval tool 400.

With these tools 400, 400', stripping sleeves 300 can easily be installed by placing the tool 400, 400' with a stripping sleeve 300 opposite the BOP 10, 11, dosing the BOP 10 110 to a predetermined stroke so that the packing unit 16, 116 grips the elastomeric sleeve 304 of the stripping sleeve 300, and then withdrawing the tool 400, 400'. Removal is in much the same way or alternatively as the drill bit is brought to surface it or the typically larger outer diameter of the lower drilling assembly can be used to bring it to surface after relaxing the annular.

Those having a basic understanding of the process will appreciate that the stripping sleeve may be relocated to different areas, volumes, or locations, based upon design constraints, without departing from the scope of the present invention. As well, those having a basic understanding of the process will appreciate that the number of units of stripping sleeve may vary, beginning with at least one unit, without departing from the scope of the present invention.

Figures 11A, 11B:
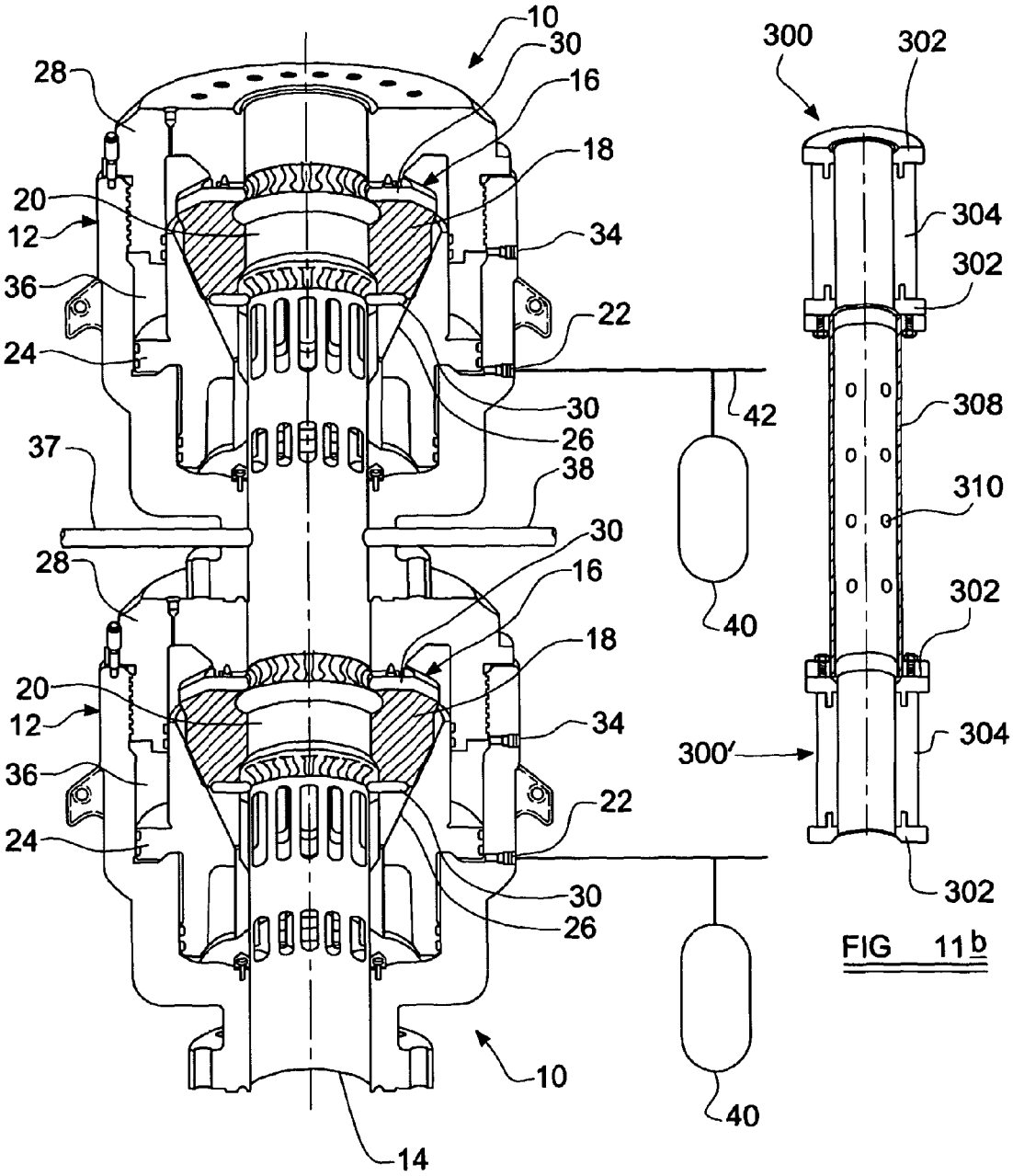
FIG. 11*a* is a cutaway view of a dual annular blowout preventer assembly.
FIG. 11*b* is a cutaway view of a dual stripping sleeve assembly suitable for use in the dual annular blowout preventer assembly shown in FIG. 11*a*.

As discussed above in relation to FIGS. 7*a* and 7*b*, a stripping sleeve in accordance with the invention may be used in relation to a wedge type annular BOP 10 in addition to a spherical BOP 110. FIG. 11*a* shows a cutaway assembly consisting of two wedge type annular BOPs 10. The conventional design of such BOPs 10 allows them easily to be bolted together as shown. A first fluid flow line 36 is provided that allows supply of fluid between the two BOPs 10. An exit path for the fluid is provided by a second fluid flow line 38. The fluid circuit is described further below. Both BOPs 10 are shown with a surge bottle 40. The use of surge bottles for stripping operations is well understood by those skilled in the art of stripping. Surge bottles 40 are usually filled with a compressible medium such as Nitrogen gas and they serve to allow the pistons 24 to move when a larger diameter tubular section e.g. a tool joint moves through the annular pushing out the packing unit 16 forcing the piston 24 down. With constant hydraulic fluid pressure applied from the surge bottle 40 via line 42 through port 22, this feature allows a variable diameter tubular to be stripped through while keeping a constant force on the pistons 24.

Figure 12A:
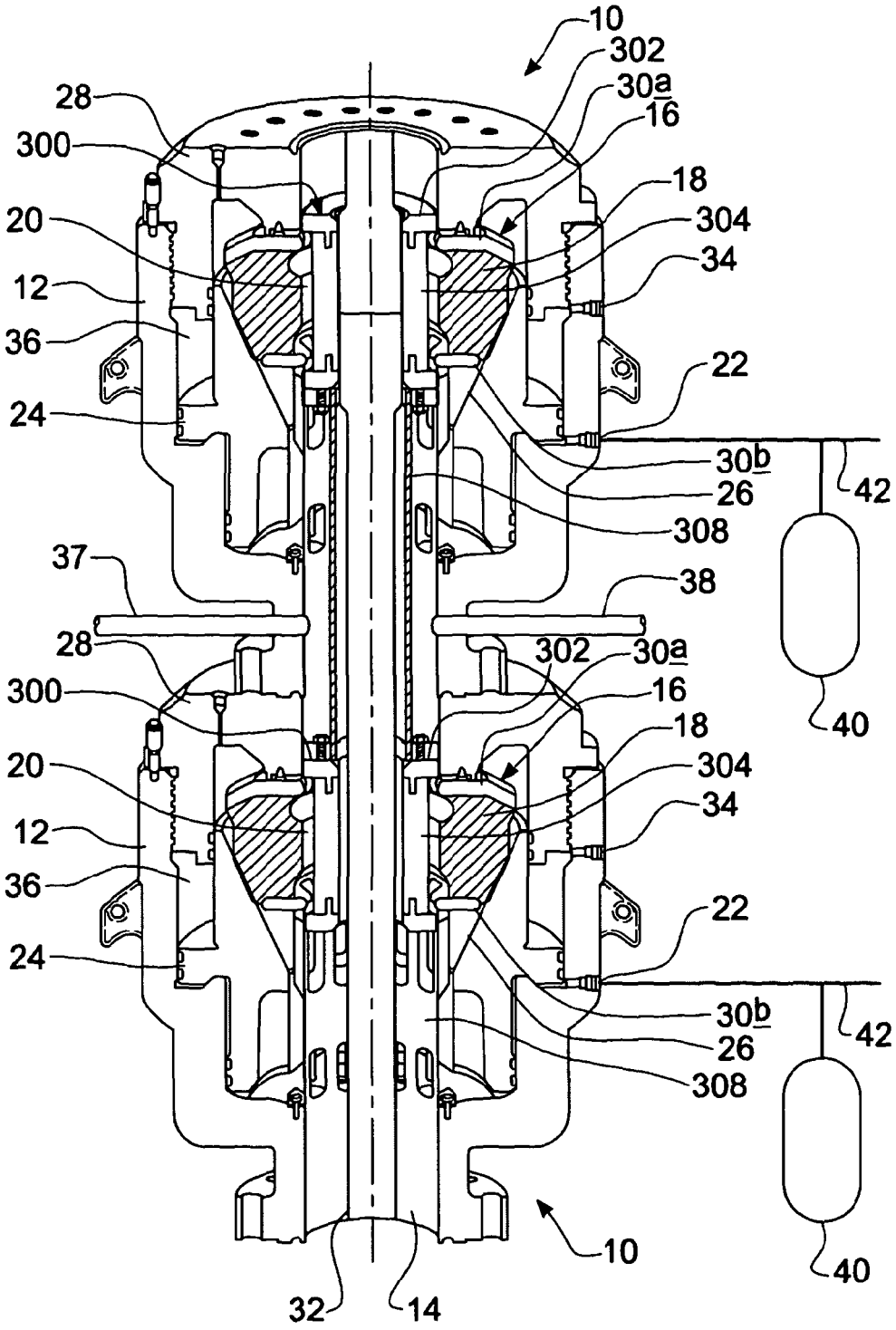
FIG. 12*a* is a cutaway view of the dual annular blowout preventer assembly with the dual stripping sleeve installed.

In FIG. 11*b*, a dual stripper sleeve assembly 300' is shown consisting of two stripping sleeves 300 interconnected by a rigid tubular 308 which is provided with holes 310. This assembly 300' allows two stripping sleeves 300 to be installed in the dual BOP assembly shown in FIG. 11*a* with the correct spacing to put the two stripping sleeves 300 in the correct position for the packing units 16 to engage the sleeves 300 simultaneously as shown in FIG. 12*a*. For clarity this does not show a running tool.

Figure 12B:
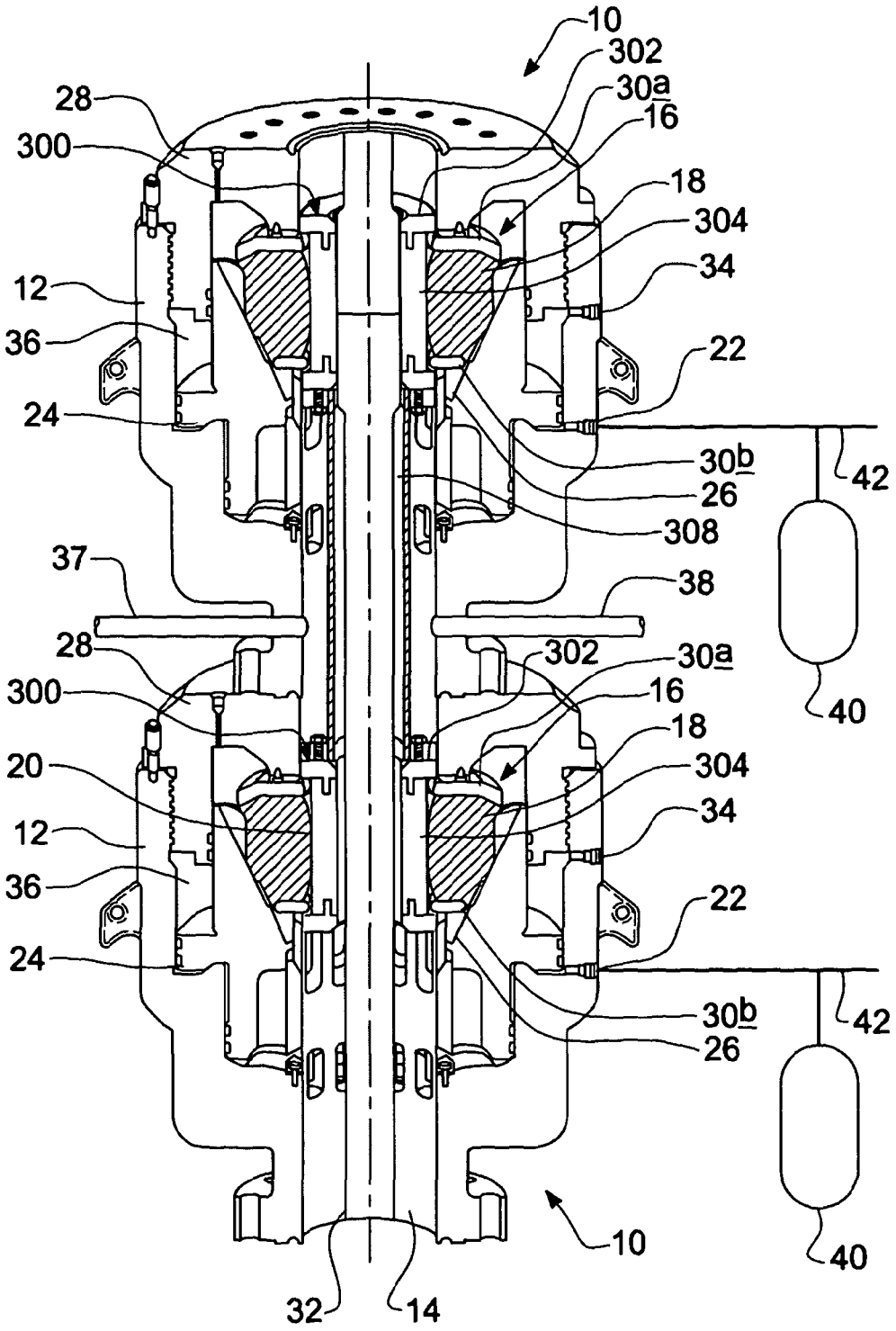
FIGS. 12*b*, 12*c* and 12*d* show the sequence of a tool-joint passing through the dual stripping assembly shown in FIG. 12*a*.
Figure 12C:
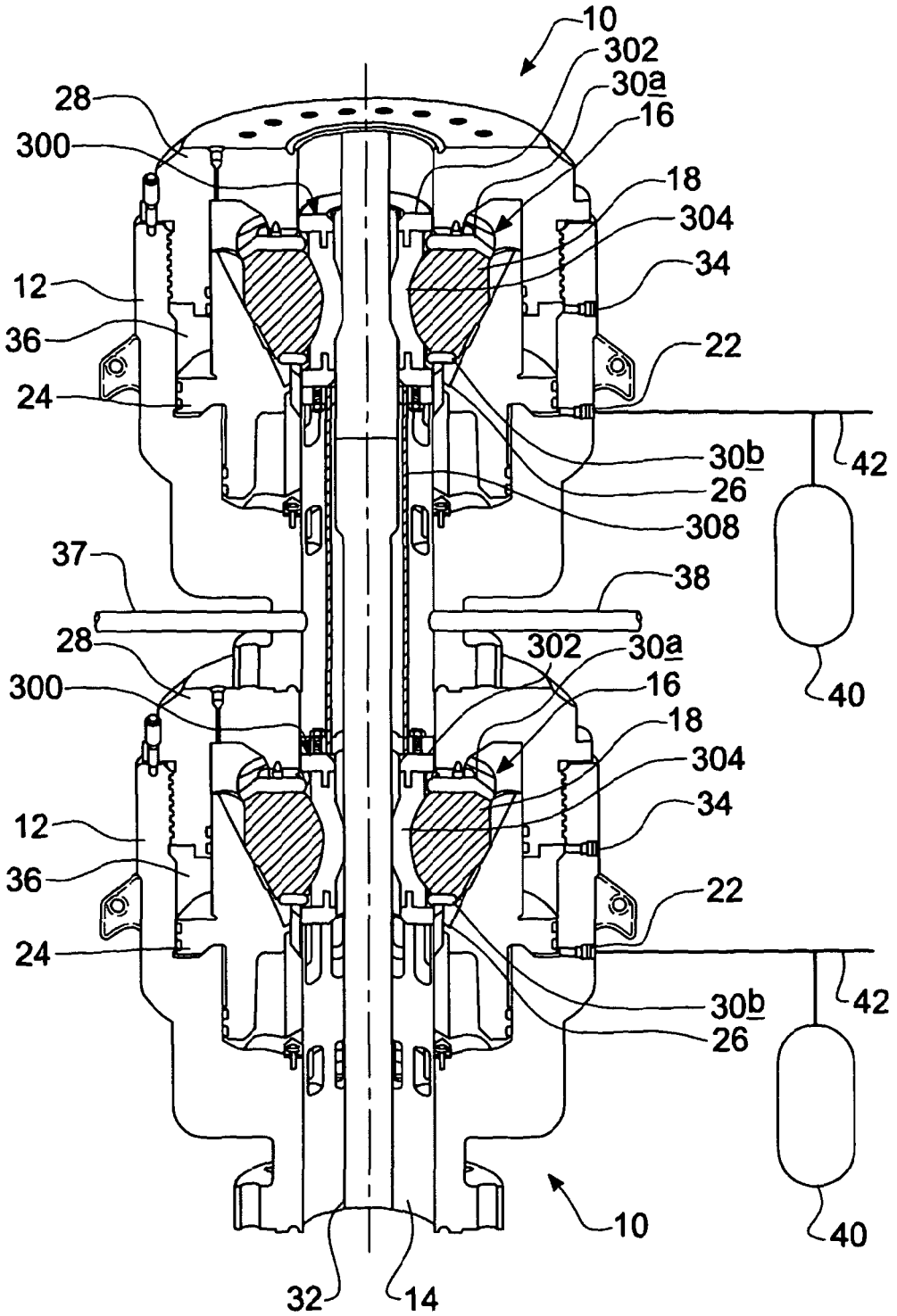
Figure 12D:
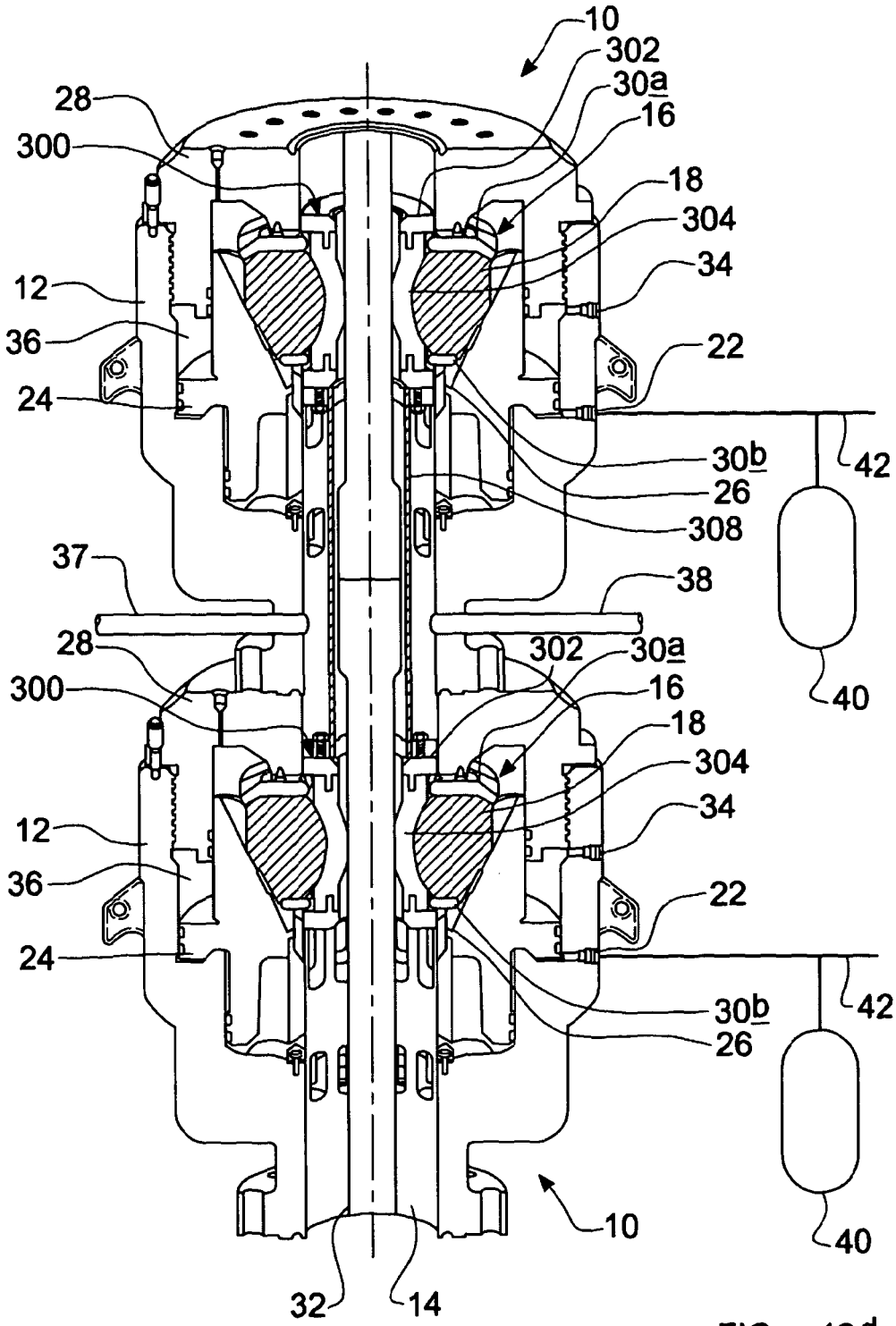

In FIG. 12*b*, the pistons 24 of the BOPs 10 have moved up, pushing in the packing units 16 and engaging the lower fingers 30*b* and upper fingers 30*a* between the annular support plates 302 of the stripping sleeves 300, effectively locking the dual stripping assembly 300' in place. FIGS. 12*c* and 12*d* show sequentially a tool joint moving down through the system to demonstrate that tool-joint is only across one of the BOPs at any given time in the stripping sequence.

By keeping a pressure in the space between the BOPs through line 36 the pressure drop across the stripping sleeve assembly 300 can be staged between the stripping elements 300, thus assisting in providing two reliable barriers at all times. For example, if the wellbore pressure is 1000 psi then one stripping sleeve 300 would have a differential of 1000 psi across ft. With two stripping sleeves 300 exposed to 500 psi between the BOPs 10, each stripping sleeve 300 will only be exposed to 500 psi differential. It has been found that lower rates of wear of the sealing element of a BOP are experienced with lower well pressures, and so this staging of the pressure across the stripping sleeves 300 may enhance the longevity of the stripping sleeves 300.

Figure 13:
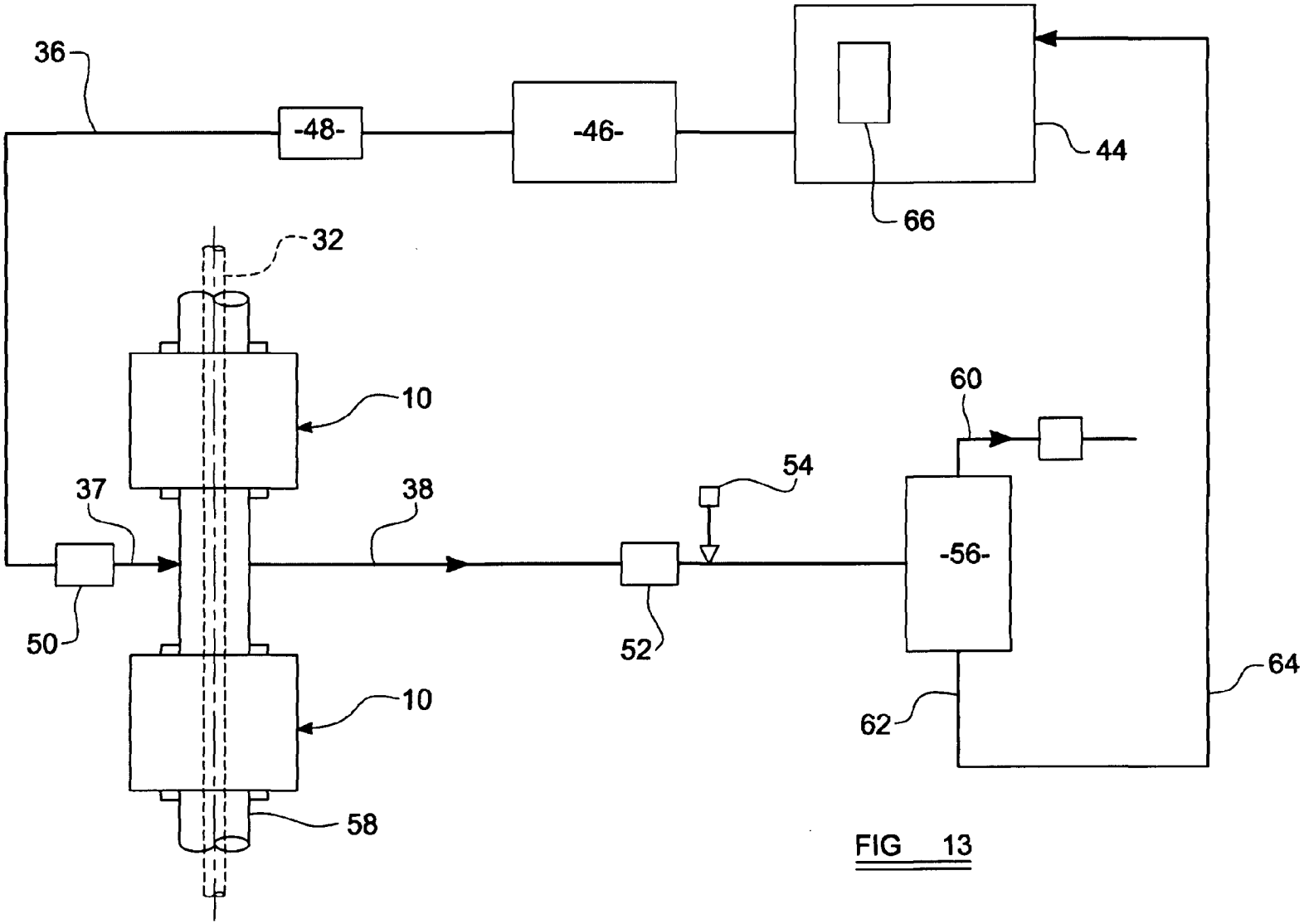
FIG. 13 shows a schematic illustration of a fluid circuit used to keep pressure between the dual annular blowout preventer assembly shown in FIGS. 12*a*-12*d*.

In FIG. 13 a fluid circuit is disclosed to enable a constant pressure to be held between the two BOPs 10. The fluid can be water or oil based or other suitable fluid compatible with the drilling fluid being used. The intent of the system is to provide a constant fluid pressure between the two BOPs 10. For the purposes of this discussion it is assumed the two pistons 24 are forced dosed engaging the stripping sleeves 300 around the drill string 32 as previously explained.

A fluid reservoir 44 supplies fluid to a pump 46 which pumps fluid under pressure through a first flow meter 48 down the fluid flow line 36 to the space between the two BOPs 10 via a check valve 50. The fluid exits via line 38 through a second flow meter 52 and a backpressure device 54 such as a choke, adjustable choke or valve. After leaving the backpressure device 54 the fluid is taken to an atmospheric separator 56 that allows safe venting of any gas from wellbore 58 that may have bypassed the lower stripping sleeve 300 (not shown). The gas is vented through a vent line 60 to a safe venting area. Fluid can exit the separator from an outlet and is returned to the fluid reservoir 44 via return line 64. The fluid reservoir can have a level device 66 or other means of verifying the fluid level and therefore the volume of fluid in the fluid reservoir 44. The reservoir 44 can be replenished from an external source (not shown).

With this fluid circuit a constant pressure can be held between the BOPs. With the in and out metering capability, any fluid loss from the system across the stripping sleeves can be verified and any fluid gain by wellbore fluids bypassing the lower stripping sleeve 300 can be verified. Such a system provides a high degree of safety for the operation as a failure of the lower stripping sleeve 300 can be safely contained by the choking effect of the backpressure device 54.

It will be appreciated that a dual stripping sleeve assembly 300 illustrated in FIG. 11*b* could equally well be used in an assembly of spherical BOPs 110, as could the fluid flow circuit illustrated in FIG. 13.

Figure 14:
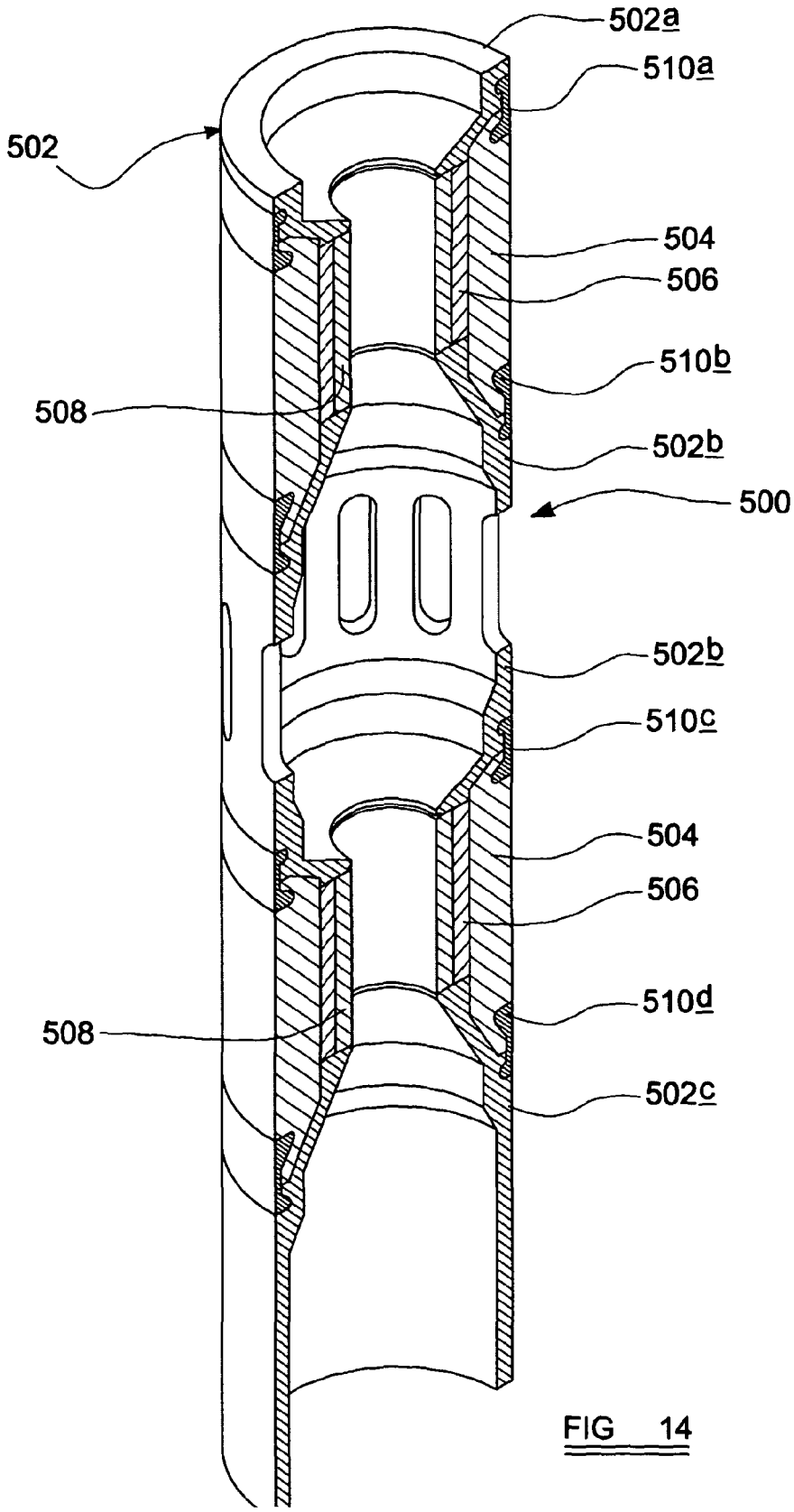
FIG. 14 is a cut away perspective view of a further embodiment of dual stripping sleeve according to the invention.
Figure 15:
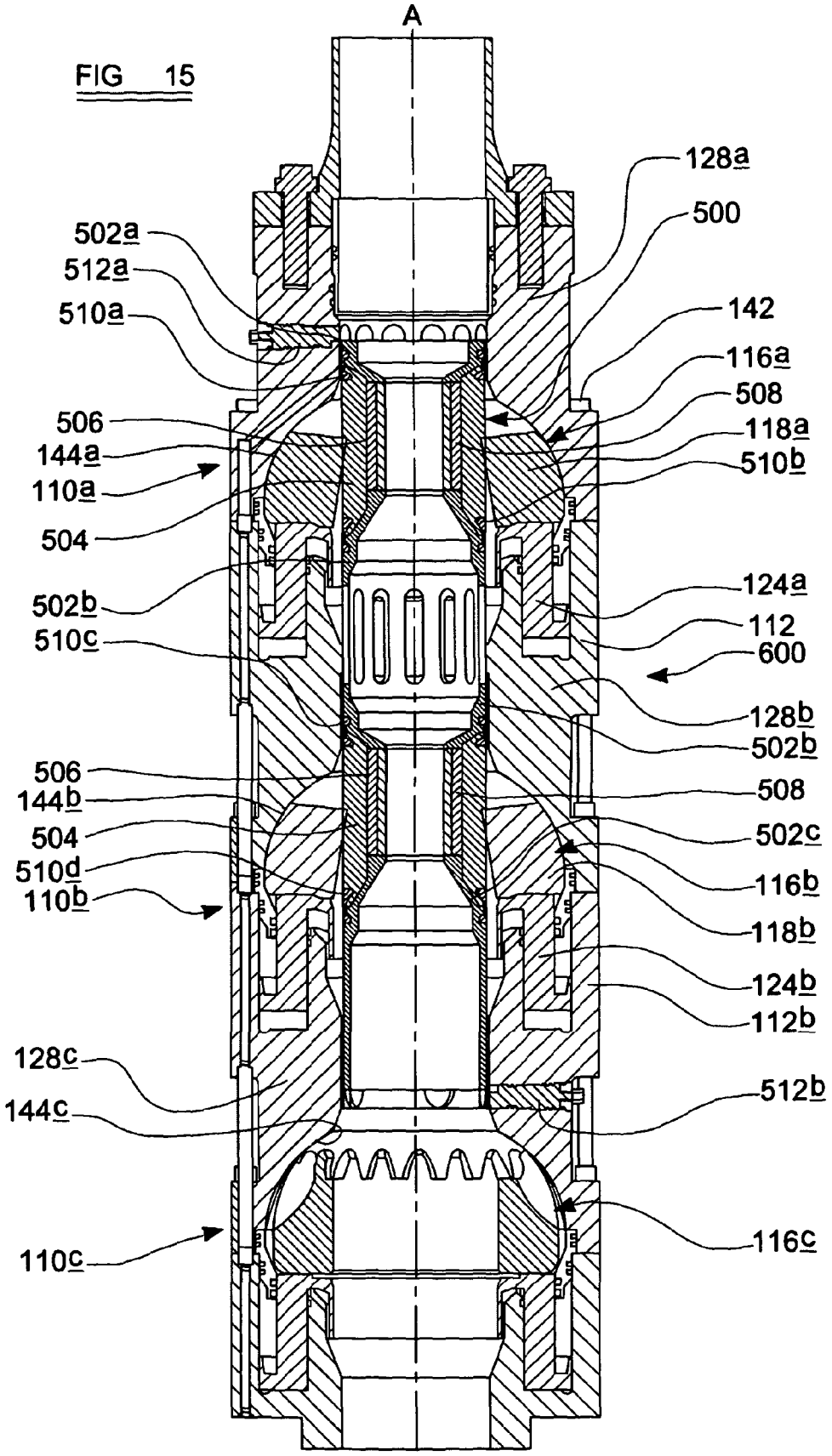
FIG. 15 is a longitudinal cross-sectional view of the dual stripping sleeve shown in FIG. 14 in a blowout preventer stack comprising three spherical annular blowout preventer.

Referring now to FIG. 14, this shows an alternative configuration of dual stripping sleeve 500 which comprises a support framework 502, which is formed in three parts which are, in a preferred embodiment of the invention, fabricated from a steel. The first part 502*a* is uppermost when the stripping sleeve 500 is in use, mounted in a BOP stack 600 as shown in FIG. 15, and comprises an annular collar with a lip extended radially inwardly from the lowermost end of the collar, the lip being inclined towards the lowermost end of the sealing assembly at an angle of around 45° to the longitudinal axis A of the BOP stack 600. The inclined lip has at its radially inward edge an edge portion with a surface which lies in a plane generally normal to the longitudinal axis A of the BOP stack 600 and which faces the second part 502*a* of the support frame 502.

The second part 502*b* is below the first part 502*a* and comprises a tubular wall with a generally circular cross-section, having at both its uppermost and lowermost ends a radially inwardly extending lip. Both lips are inclined at an angle of around 45° to the longitudinal axis A of the BOP stack 600 away from the tubular wall. The uppermost lip is therefore inclined towards the first part 502*a* of the support frame, whilst the lowermost lip is inclined towards a third, lowermost, part 502*c* of the support frame 502. The inclined lips at the uppermost and lowermost ends of the second part 502*b* have at their radially inward edge an edge portion with a surface which lies in a plane generally normal to the longitudinal axis A of the BOP stack 600 and which face the first part 502*b* of the support frame 502, and the third part 502*c* of the support frame 502 respectively.

The lowermost part 502*c* of the support frame 502 also comprises a tubular wall which has a generally circular transverse cross-section, with a radially inwardly extending lip at its uppermost end. The lip is also inclined at around 45° to the longitudinal axis A of the BOP stack 600 away from the tubular wall and towards the second part 502*b* of the support frame 502. The inclined lip also has at its radially inward edge an edge portion with a surface which lies in a plane generally normal to the longitudinal axis A of the BOP stack 600 and faces towards the second part 502*b* of the support frame 502.

Between the first 502*a* and second 502*b* parts of the support frame 502 is located a seal which in this embodiment of the invention comprises a seal packing element 504, and a seal, in this example comprising a first sealing element 506 and a second sealing element 508. The seal packing element 504 and the sealing elements 506, 508 together form a tube with a generally circular transverse cross-section. The seal packing element 504 forms the radially outermost surface of the tube, the second sealing element 508 forms the radially innermost surface of the tube, with the first sealing element 506 being sandwiched between the two. The length of the seal packing element 504 increases from its radially innermost portion to its radially outermost portion, with the seal elements 506, 508 being just slightly shorter than the radially innermost portion of the seal packing element 504. The ends of seal packing element 504 thus engage with the inclined face of the adjacent lips of the first 502*a* and second 502*b* parts of the support frame 502, with the seal elements 506, 508 being sandwiched between the edge portions.

A substantially identical seal is provided between the second 502*b* and third 502*c* parts of the support frame 502.

Four assembly clamps 510 are provided, to connect the support frame to the seals, a first assembly clamp 510*a* connecting the first part 502*a* of the support frame 502 to the uppermost end of the uppermost seal, a second assembly clamp 510*b* connecting the uppermost end of the second part 502*b* of the support frame 502 to the lowermost end of the uppermost seal, a third assembly clamp 510*c* connecting the lowermost end of the second part 502*b* of the support frame 502 to the uppermost end of the lowermost seal, and a fourth assembly clamp 510*d* connecting the third part 502*c* of the support frame 502 to the lowermost end of the lowermost seal.

In this embodiment of the invention, each assembly clamp 510 is a ring with a C-shaped transverse cross-section. A first portion of the clamp 510 is located in a circumferential groove in the radially outermost face of the respective support frame 502 part whilst a second portion of the clamp 510 is located in a circumferential groove in the radially outermost face of the respective seal packing element 504, the clamp 510 thus spanning the join between the support frame 502 and the seal.

Figure 3:
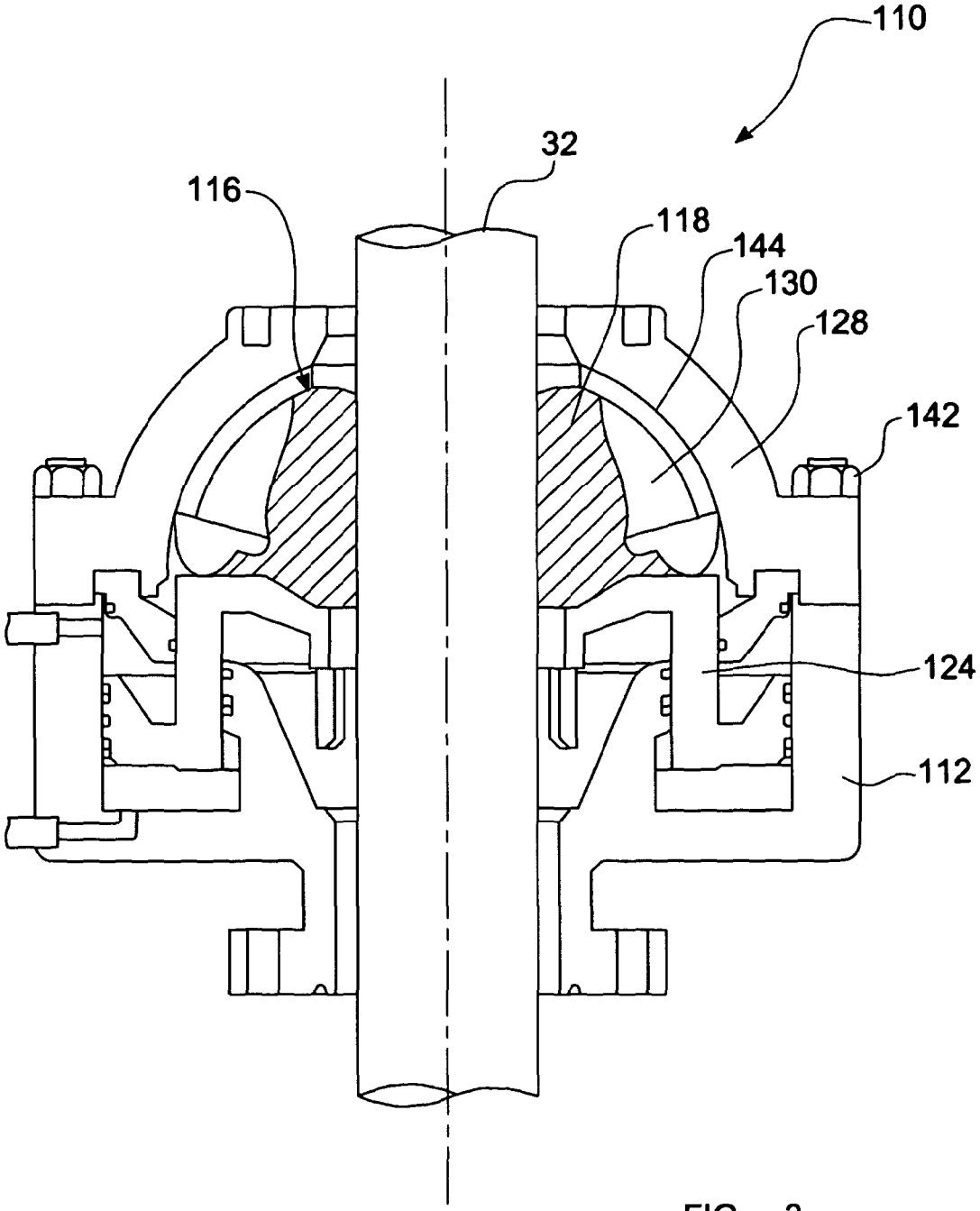
FIG 3 (PRIOR ART)
FIG. 3 is a cutaway view of a prior art spherical annular type blowout preventer.
Figure 4B:
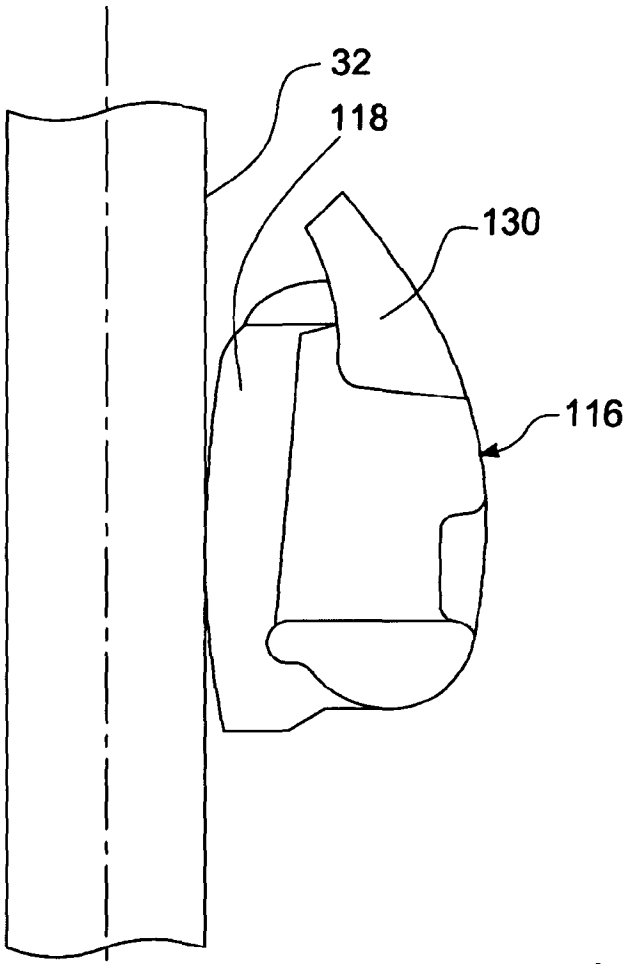
FIG 4b (PRIOR ART)
FIG. 4*b* is a cross-sectional view of a prior art spherical annular blowout preventer packing unit in the dosed position.
Figure 4A:
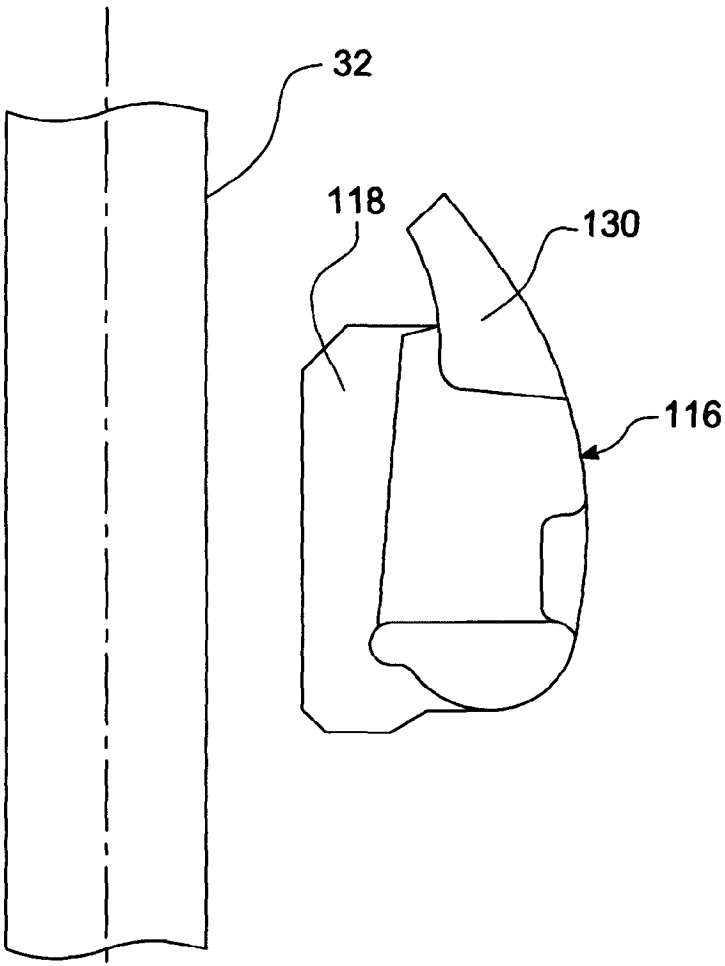
FIG 4a (PRIOR ART)
FIG. 4*a* is a cross-sectional view of a portion of a prior art spherical annular type blowout preventer packing unit in the open position.
Figure 5:
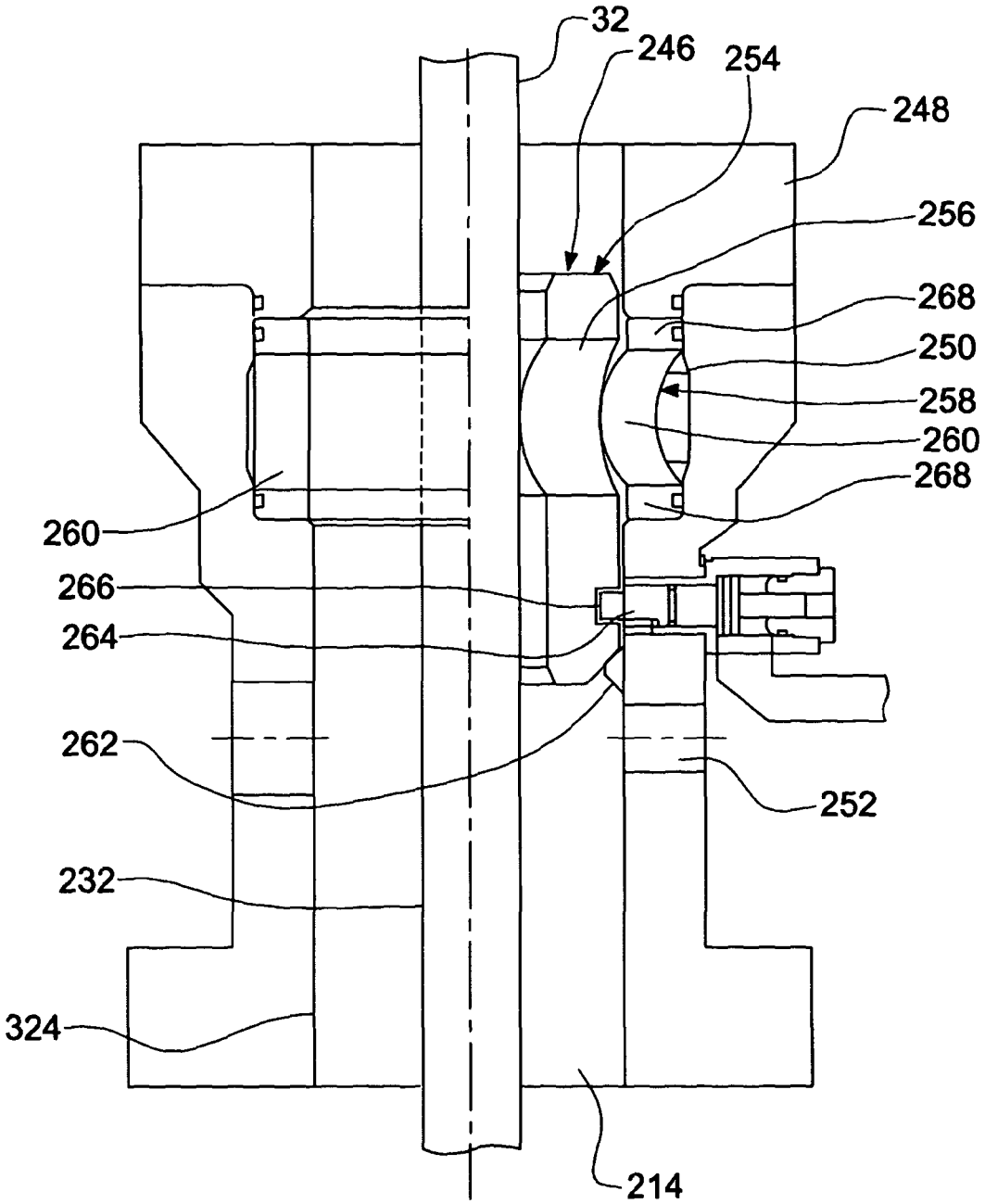
FIG 5 (PRIOR ART)
FIG. 5 is a cutaway view of a prior art riser isolation tool.

This embodiment of dual stripping sleeve 500 is shown in FIG. 15 located in the generally central bore or passage of a BOP stack 600 comprising three spherical annular BOPS 110*a*, 110*b*, 110*c* similar to the spherical annular BOP 110 illustrated in FIG. 3. The uppermost seal of the dual stripping sleeve 500 adjacent the packing element 116*a* of the uppermost BOP 110*a*, and the lowermost seal adjacent the packing element 116*b* of the middle BOP 110*b*, the first part of the support frame 502 engaging with the uppermost housing 128*a* of the uppermost BOP 110*a*, the second part of the support frame 502 engaging with a first combined housing part comprising the lowermost housing 112*a* of the uppermost BOP 110*a* and the uppermost housing 128*b* of the middle BOP 110*b*, and the third part 502*c* of the support frame 502 engaging with a second combined housing part comprising the lowermost housing 112*b* of the middle BOP 110*b* and the uppermost housing 128*c* of the lowermost BOP 110*c*.

When the pistons 124*a*, 124*b* of the uppermost BOP 110*a* and the middle BOP 110*b* move to the active position, each packing element 116*a*, 116*b* is compressed around and engages with the radially outermost surface of the adjacent seal packing element 504. This compresses the seal, and, when a drill string is present in the BOP stack 600, causes each seal to close tight, like a sphincter, around the drill string. When the BOP stack 600 is mounted in a riser, the engagement of the seal with the drill string, the packing elements 116*a*, 116*b* with the seal, and the packing elements 116*a*,

116*b* with the housing 128*a*, 128*b* substantially prevents flow of fluid along the annular space between the BOP housing and the drill string. As such, the riser annulus is closed by the movement of the piston 124*a*, 124*b* of either of the uppermost BOP 110*a* or middle BOP 110*b* to the active position.

In this embodiment, the stripping sleeve 500 does not extend into the lowermost BOP 110*c* in the stack 600, so when activated by movement of the pistons 124*a*, 124*b* as described above, the packing element 116*c* of the lowermost BOP 110*c* seals around the drill string without there being an intervening seal. This means that when either or both of the seal elements 506, 508 in the stripping sleeve 500 wear out, the stripping sleeve 500 can be removed from the BOP stack 600 and replaced with a new stripping sleeve 500, whilst the lowermost BOP 110*c* maintains pressure in the annulus. It should also be noted that the packing element 116*c* in at least the lowermost BOP 110*c* can be activated to fully close the generally central bore or passage of the BOP stack 600 without there being a drill string or any other component in the generally central bore or passage of the BOP stack. The same may be true either of the other two BOPS 110*a*, 110*b*, although in normal use, they would not be required to do this as the stripping sleeve 500 is usually in place.

In this embodiment of stripping sleeve 500, the two tubular walls are provided with an array of slots which extend generally parallel to the longitudinal axis A of the BOP stack 600. Hydraulic ports (not shown) are provided through the housing connecting these slots to the exterior of the housing so that, in use, lubricant may be circulated through these ports into the generally central bore or passage of the stripping assembly 500 between the two seals, and between the lowermost seal of the stripping sleeve 500 and the lowermost packing element 116*c* of the BOP stack 600. It will be appreciated that, by virtue of the supply of lubricant to these regions, the lubricant may assist in reducing the frictional forces between the seal elements 506, 508/packing element 116 and the drill string when closed around a drill string.

In this embodiment of the invention, movement of the stripping sleeve 500 relative to the BOP stack 600 is substantially prevented by means of a plurality of hydraulically actuated locking dogs 512*a*, 512*b*. In this embodiment of the invention, two sets of locking dogs 512*a*, 512*b* are provided—an upper set 512*a*, which is located in the uppermost housing 128*a* of the uppermost BOP 110*a*, and a lower set 512*b*, which is located in the second combined housing part between the middle BOP 110*b* and the lowermost BOP 110*c*. It should be appreciated that the locking dogs 512*a*, 512*b* need not be in exactly those locations. Also in this embodiment of the invention, each set 512*a*, 512*b* comprises a plurality of locking dogs which are located in an array of apertures around a circumference of the housing.

A radially outward end of each locking dog 512*a*, 512*c* is provided with an actuating stem which extends into a hydraulic connector mounted in an aperture at the exterior surface of the housing. Sealing devices are provided between the hydraulic connector and the housing and between the hydraulic connector and the stem, so that the hydraulic connector and stem form a piston and cylinder arrangement. The locking dog 521*a*, 512*b* may therefore be pushed into a locking position in which a radially inward end of the locking dog 512*a*, 512*b* extends into the generally central bore or passage of the BOP stack 600 by the supply of pressurised fluid to the hydraulic connector.

The stripping sleeve 500 is dropped or lowered in the in the uppermost end of the BOP stack 600 with the uppermost set of locking dogs 512*a* retracted into the housing whilst the lowermost set of locking dogs 56 are in the locking position. The stripping sleeve 500 thus comes to rest with its lowermost end in engagement with the lowermost locking dogs 512*b*. Once the stripping sleeve 42 is in this position, hydraulic fluid is supplied to the uppermost hydraulic connectors to push the uppermost locking dogs 512*a* into the locking position in which their radially inward ends extend into the generally central bore or passage of the housing. The stripping sleeve 500 is positioned such that when the locking dogs 512*a*, 512*b* are in the locking position it lies between the two sets of locking dogs 512*a*, 512*b*, and an end of the stripping sleeve 500 engages with each set of locking dogs 521*a*, 512*b*. By virtue of this, longitudinal movement of the stripping sleeve 500 in the BOP stack 600 is prevented, or at least significantly restricted.

It should be appreciated that a drill string extending through a BOP or BOP stack may rotate relative to the BOP stack during drilling, and that there may also be translational movement of the drill string generally parallel to the longitudinal axis A of the BOP stack, for example during stripping or tripping operations, or, where the drill string is suspended from a floating drilling rig, due to movement of the drilling rig with the swell of the ocean. When a seal is pushed into engagement with the drill string as described above, this relative movement will cause wear of the seal. The materials from which the elastomeric seal 304 or seal elements 506, 508 of the stripping sleeves 300, 500 are constructed are selected to reduce wear of the seal and heating effects due to frictional forces between these elements and the drill string.

In particular, in the first embodiment of stripping sleeve 300 described above and illustrated in FIGS. 6*a*, 6*b*, and 6*c*, the elastomeric sleeve 304 may be made from polyurethane or hydrogenated nitrile butadiene rubber.

Alternatively, in one embodiment of the stripping sleeve 500 illustrated in FIG. 14, the second sealing element 508, which is in contact with the drill string, may be a polymeric material selected to provide such properties whilst having the mechanical integrity to provide an effective seal. The polymeric sealing element 508 may be made from polytetrafluoroethylene (PTFE) or a PTFE based polymer. To provide the seal with this necessary resilience to move out of engagement with the drill string when pressure from the packing elements 116*a*, 116*b* of the adjacent BOP 110*a*, 110*b* is released, there is a further seal element, namely the first seal element 506 which is made from an elastomeric material. The elastomeric sealing element 66 may be made from polyurethane or hydrogenated nitrile butadiene rubber.

Whilst in the elastomeric sealing element 506 and the polymeric sealing element 508 may be fabricated as separate tubes and placed in mechanical engagement with one another, or they may be co-moulded to form a single part. In one embodiment of seal, the polymeric seal 508 includes a plurality of apertures (preferably radially extending apertures), and the elastomeric sealing element 506 is cast or moulded onto the polymeric seal 508 so that the elastomer extends into, and preferably substantially fills these apertures.

While the invention has been described with respect to a limited number of embodiments, those with extensive experience in well control operations, and having benefit of this disclosure, will appreciate that other embodiments may be devised which do not depart from the scope of the invention as disclosed to herein. Accordingly, the scope of the invention should be limited only by the attached claims.

The invention claimed is:

1. A blowout preventer assembly comprising an annular blow out preventer having an annular packing unit and an actuator operable to reduce the internal diameter of the annular packing unit, wherein the assembly further comprises a stripping sleeve having a tubular elastomeric sleeve which in use is positioned generally centrally of the packing unit so that the packing unit surrounds at least a portion of the elastomeric sleeve, wherein the actuator comprises a piston movable generally parallel to the longitudinal axis of the blowout preventer by the supply of pressurised fluid to the annular blow out preventer, wherein the annular blow out preventer has an outer housing, and the annular packing unit and the stripping sleeve are rotationally static relative to the outer housing, wherein the stripping sleeve further comprises two annular support parts, the elastomeric sleeve being positioned between the two support parts, and wherein the outer diameter of each of the support parts is greater than the outer diameter of the elastomeric sleeve.

2. A blowout preventer assembly according to claim 1 wherein the annular packing unit comprises an elastomeric body and at least one generally rigid insert, the insert lying at least partially between the two annular support parts when the annular packing unit engages with the elastomeric sleeve.

3. A blowout preventer assembly according to claim 2 wherein the annular packing unit comprises first and second generally rigid inserts, the elastomeric body lying between the first and second inserts and the first insert being at a first end of the annular packing unit adjacent to one of the support parts and the second insert being at a second end of the annular packing unit adjacent to the other of the support parts, both inserts lying at least partially between the two support parts when the packing unit is engaged with the elastomeric sleeve.

4. A blowout preventer assembly according to claim 1 wherein the inner diameter each of the support parts is substantially the same as the inner diameter of the elastomeric sleeve.

5. A blowout preventer assembly according to claim 1 wherein each support part is provided with a circular ridge which extends into an end of the elastomeric sleeve.

6. A blowout preventer assembly according to claim 1 wherein the maximum outer diameter of the stripping sleeve is less than the inner diameter of the annular packing unit when the packing unit is not being acted on by the actuator.

7. A blowout preventer assembly according to claim 1 wherein the stripping sleeve further comprises a polymeric sealing element which is arranged radially inwardly of the elastomeric sleeve.

8. A blowout preventer assembly according to claim 7 wherein the polymeric sealing element contains a plurality of apertures into which the elastomeric sleeve extends.

9. A blowout preventer assembly according to claim 1, further comprising another annular blow out preventer and another stripping sleeve, wherein the two annular blow out preventers are arranged around a common central passage and are longitudinally displaced with respect to one another along the common central passage, and the two stripping sleeves are connected by means of a tubular connector.

10. A blowout preventer assembly according to claim 9 wherein the packing units and actuators of the annular blow out preventers are contained in a housing which encloses the common central passage, there being a conduit provided in the housing to connect the volume of the common central passage between the two annular blow out preventers with the exterior of the housing.

* * * * *